US006675837B1

(12) United States Patent
Russ et al.

(10) Patent No.: US 6,675,837 B1
(45) Date of Patent: Jan. 13, 2004

(54) WOVEN FABRIC HAVING MODIFIED SELVAGE AND RELATED ASSEMBLY AND METHOD FOR THE MANUFACTURE THEREOF

(75) Inventors: Randall Hugh Russ, Lafayette, GA (US); Maurice D. Atwell, III, Ringgold, GA (US); Derek S. Bass, Jefferson, GA (US); Andy Ellis, Ringgold, GA (US); Don Hendrix, Ringgold, GA (US); Tracey G. Johnston, Rossville, GA (US)

(73) Assignee: SI Corporation, Chickmauga, GA (US)

( * ) Notice: Subject to any disclaimer, the term of this patent is extended or adjusted under 35 U.S.C. 154(b) by 431 days.

(21) Appl. No.: 09/678,889

(22) Filed: Oct. 4, 2000

(51) Int. Cl.[7] ..... D03D 41/00

(52) U.S. Cl. ..... 139/11; 139/434; 139/195; 139/302; 139/303

(58) Field of Search ..... 139/434, 195, 139/302, 303

(56) References Cited

U.S. PATENT DOCUMENTS

| | | | | | |
|---|---|---|---|---|---|
| 2,816,577 | A | | 12/1957 | Shimwell | 139/195 |
| 3,083,738 | A | | 4/1963 | Pfarrwaller et al. | 139/126 |
| 3,137,321 | A | * | 6/1964 | Wasylewiez | 139/434 |
| 3,153,430 | A | * | 10/1964 | Kundrach | 139/434 |
| 3,457,966 | A | | 7/1969 | Cujai | 139/122 |
| 3,633,037 | A | | 1/1972 | Langenbeck | 250/219 |
| 4,252,154 | A | * | 2/1981 | Alexander, III | 139/304 |
| 4,305,184 | A | | 12/1981 | Woythal | 26/51.5 |
| 4,421,141 | A | * | 12/1983 | Brouwer | 139/54 |
| 4,619,527 | A | | 10/1986 | Leuenberger et al. | 356/238 |
| 4,656,360 | A | | 4/1987 | Maddox et al. | 250/571 |
| 4,987,663 | A | | 1/1991 | Epple | 26/51.3 |
| 5,685,347 | A | | 11/1997 | Graham et al. | 139/390 |
| 5,718,267 | A | * | 2/1998 | Kawabata et al. | 139/434 |
| 6,102,082 | A | * | 8/2000 | Hehle et al. | 139/302 |
| 6,240,976 | B1 | * | 6/2001 | Satoh et al. | 139/434 |
| 6,289,942 | B1 | * | 9/2001 | Nakada et al. | 139/434 |

* cited by examiner

*Primary Examiner*—Rodney M. Lindsey
*Assistant Examiner*—Robert Muromoto
(74) *Attorney, Agent, or Firm*—Renner, Kenner, Greive, Bobak, Taylor & Weber

(57) ABSTRACT

A roll (25) of woven fabric (30) having a length greater than the diameter thereof wherein the diameter (28) is substantially the same across said length of the roll. An assembly (50) operable with the tucking units of the picking (51) and receiving (52) ends of a weaving loom (53) for producing woven fabrics (30) comprises plate means (74) attached to the loom; main drive block means (76) connected to a harness (60) of the loom; operating rod means (78), having first and second ends (92, 95) and attached to the main drive block means at the first end (92) and pivotally mounted to an upper surface of the plate means at the second end (95); lifter means (80) connected to the operating rod means, proximal to the second end, for lifting the weft end gripper (70) of the loom; and means for selectively engaging (82) the weft end gripper, operatively associated with the operating rod means, whereby the weft end gripper positions consecutive pick lines (32) in an alternating fashion, allowing every other one to be tucked into the selvage of the fabric, while adjacent pick lines are untucked. A method for producing woven fabrics (30) having a tucked-untucked selvage comprising providing an assembly (50) at the picking (51) and receiving (52) ends of a weaving loom (53), operable with the weft end grippers (70) of the loom; attaching the assembly to a harness (60) of the weaving loom; and operating the assembly so that the weft end grippers move every other weft yarn (32) out of reach of the tucking needles of the loom.

15 Claims, 20 Drawing Sheets

WOVEN FABRIC HAVING MODIFIED SELVAGE AND RELATED ASSEMBLY AND METHOD FOR THE MANUFACTURE THEREOF

TECHNICAL FIELD

This invention relates principally to primary backing fabric utilized for the tufting of carpet. Primary backing fabric of the present invention provides a reduced selvage and indicia in the pick lines at periodic intervals which allow for the manufacture of improved carpet. An assembly operable with the tucking needles and weft end grippers of the weaving loom is provided which allows for a tucked-untucked selvage in the woven fabric. A method for the manufacture of woven fabric having a tucked-untucked selvage is also provided.

BACKGROUND OF THE INVENTION

Broadloom carpet is conventionally manufactured by tufting the face yarns into a woven or nonwoven primary backing. Conventional woven primary backing may have a bowed or skewed pick line due to the typical construction of the fabric. A bowed pick line is one where the ends of a fill yarn are at basically the same distance along the length of the fabric, but the fill yarn between the edges gains or loses in distance along the length (bends or curves). Bow is measured by drawing a straight line between the two ends of a fill yarn and measuring the greatest distance from this straight line to the fill yarn in the body of the fabric. A skewed pick line is one where the fill yarn is basically straight, but one end of the fill yarn gains or loses along the length of the fabric. Skew is measured by drawing a straight line perpendicular to the fabric edge from one end of the filling and measuring the distance of the opposite end of the fill yarn from the perpendicular line.

After the face yarns have been tufted into the primary backing, there is a face side of the carpet that will be visible after installation and there is a backside of the primary backing which is covered by the backstitch or the exposed crossovers of the face yarn after insertion through the backing. The backstitch is secured by application of an adhesive and a secondary backing fabric. The adhesive acts to bind the backstitch while the secondary backing contains this adhesive and acts to further stabilize the structure of the carpet. The most popular adhesives currently in use are different types of latex commonly styrene butadiene latex.

It is critical that pattern broadloom carpet have straight pattern lines perpendicular to the edge for installation purposes. If the pattern lines are not straight at the time the carpet is coated and the secondary backing is applied, the bow or skew will be set into the carpet. Bow and skew may be due to bowed or skewed primary backing and/or tension variations in the carpet manufacturing processes. Small degrees of bow and skew may be compensated for during the carpet manufacturing processes or during installation through stretching techniques.

The foregoing problems are often the result of tucking of the severed weft yarns (picks) on opposing sides of the primary fabric. Tucking is necessary to prevent unwarranted raveling of the fabric, which would otherwise occur with subsequent handling during manufacture of the carpet. Tucking of the weft ends results in a build-up of the thickness in the selvages (edges) of the fabric which accumulates in a roll of fabric to create a dog-bone effect at each edge.

The resulting dimensional changes in the fabric can alter the desired tufting of the face yarns in a pre-determined pattern and as a result, during installation of the carpet, the alignment of patterns in adjacent rolls of the carpet can be off sufficiently that it cannot be corrected by stretching. Such problems are particularly notable in large rooms such as banquet halls, meeting rooms, gambling casinos and the like, which must be closed for re-carpeting. In many instances carpet installers arrive with hundreds of square yards of carpet and when pattern alignment are experienced, it may not be possible to complete the job until different rolls can be delivered, if indeed, they will fare better. Given the loss of revenue for just one evening's activities, and the fact that the work must still be done at a later date, and the need for uniform carpet can be appreciated.

One solution to the selvage problem is to untuck every other pick line so that the selvage area does not increase in thickness to a degree sufficient to result in build-up. U.S. Pat. No. 3,457,966 describes an apparatus and method for forming a tucked in selvage characterized in that certain weft yarns are periodically not tucked, so as to provide a woven fabric having reduced thickness selvages.

Typical nonwoven primary backing is constructed in such a manner that there is no bow or skew possible due to the orientation of the fibers. Although this orientation eliminates bow and skew due to the primary, the appearance of the carpet is muted because the nonwoven fabric does not heal itself and close back around the face yarn as with the woven fabric. Tufting efficiencies with nonwoven primary fabrics are typically reported to be lower than those of woven primary backings.

While attempts have been made heretofore to manufacture woven fabrics with reduced selvages, the art has not provided a facile means or device by which to do so. Nor, has the art necessarily provided a woven fabric or roll of fabric that can be utilized in the manufacture of broadloom carpet which is consistently uniform in dimension.

BRIEF DESCRIPTION OF THE INVENTION

It is therefore, an object of the present invention to provide a novel woven fabric having a reduced selvage area.

It is another object of the present invention to provide a novel woven fabric having intermittently spaced contrasting fill lines for diagnostic purposes.

It is another object of the present invention to provide a roll of woven fabric having a reduced selvage area such that the diameter of the roll is essentially the same at the ends as it is across the center of the roll.

It is yet another object to provide a woven fabric, according to the present invention for use as a primary backing in the manufacture of broadloom carpet.

It is yet another object to provide a woven fabric, according to the present invention, having reduced bow and skew.

It is yet another object to provide a woven fabric, according to the present invention, having a tucked-untucked selvage.

It is yet another object to provide a woven fabric, according to the present invention, having a tucked-untucked selvage providing greater tensile strength of fabrics utilizing a leno latch weave to control the selvage.

It is yet another object of the present invention to provide an assembly for use on a weaving loom to provide a woven fabric having a tucked-untucked selvage.

It is still another object to provide a method for the operation of a weaving loom to provide a woven fabric having a tucked-untucked selvage.

At least one or more of the foregoing objects, together with the advantages thereof over the known art pertaining to woven primary backing fabrics and related apparatus and methods for the manufacture thereof, which shall become apparent from the specification which follows, are accomplished by the invention as hereinafter described and claimed In general the present invention provides a roll of woven fabric having a length greater than the diameter thereof wherein the diameter is substantially the same across the length of the roll.

The present invention also includes an assembly operable with the tucking units of the picking and receiving ends of a weaving loom for producing woven fabrics comprising plate means attached to the loom; main drive block means connected to a harness of the loom; operating rod means, having first and second ends and attached to the main drive block means at the first end and pivotally mounted to an upper surface of the plate means at the second end; lifter means connected to the operating rod means, proximal to the second end, for lifting the weft end gripper of the loom; and means for selectively engaging the weft end gripper, operatively associated with the operating rod means, whereby the weft end gripper positions consecutive pick lines in an alternating fashion, allowing every other one to be tucked into the selvage of the fabric, while adjacent pick lines are untucked.

The present invention also includes a method for producing woven fabrics having a tucked-untucked selvage comprising providing an assembly at the picking and receiving ends of a weaving loom, operable with the weft end grippers of the loom; attaching the assembly to a harness of the weaving loom; and operating the assembly so that the weft end grippers move every other weft yarn out of reach of the tucking needles of the loom.

The present invention also includes a method for producing woven fabrics having a tucked-untucked selvage on a weaving loom, providing selvage edge grippers and tucking needles, comprising moving the selvage gripper the forward to capture a weft yarn end; opening and closing the clamp of the selvage gripper onto the weft yarn end; catching the weft yarn end with the tucking needle and tucking it into the selvage; moving the selvage gripper forward to capture the next weft yarn end; opening and closing the clamp of the selvage gripper onto the next weft yarn end; retracting the selvage gripper and the next weft yarn end into the shed while raising the selvage gripper out of the path of the tucking needle, causing the needle to miss the yarn end; releasing the untucked yarn end; and thereafter repeating the foregoing steps in alternating fashion to produce a woven fabric having a tucked-untucked selvage.

DETAILED DESCRIPTION OF THE INVENTION

Figure 1:
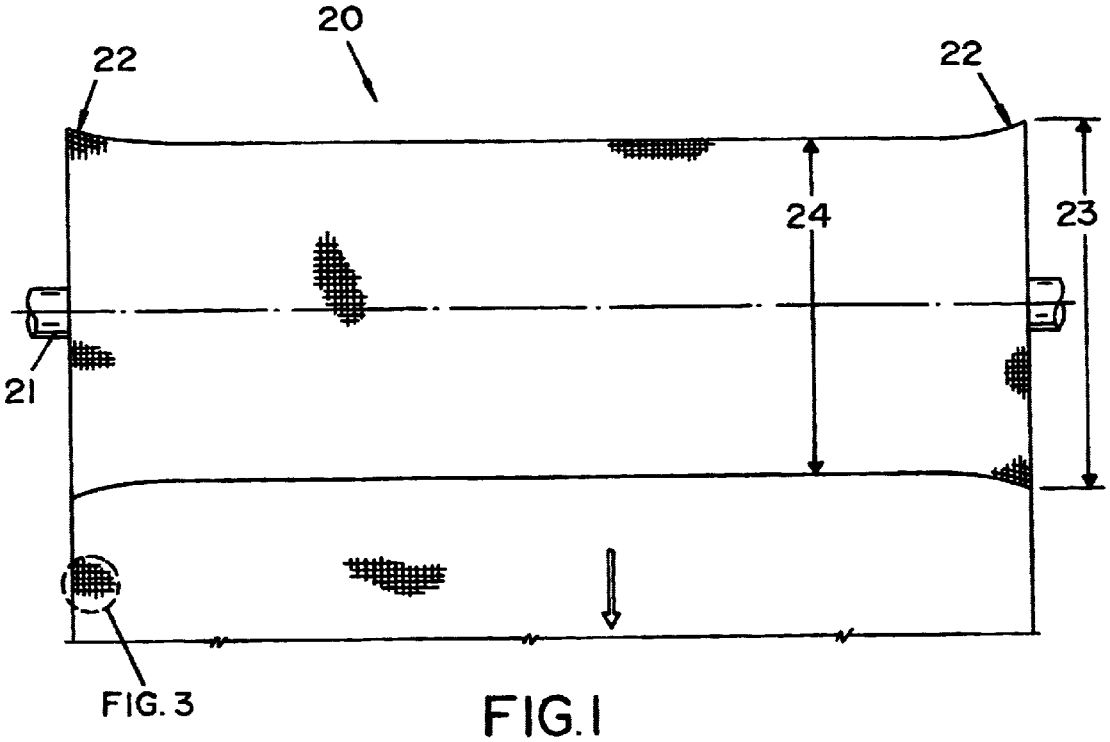
FIG. 1 (PRIOR ART)
FIG. 1 is top plan view of a roll of woven fabric, according to the prior art.

As noted hereinabove, the woven fabrics according to the present invention are useful as primary backing fabrics for the manufacture of tufted broadloom carpet. The invention is not limited to or by any particular type of carpet or manufacturing process but rather, the resulting primary backing fabrics can be relied upon to produce broadloom carpet essentially free from bow and skew so as to provide uniform and true patterns, which is essential for the installation of carpet in large areas where edges of separate rolls must be joined together.

The woven product to serve as the primary backing is most commonly produced by employing a plain weave with slit tape warp and fill yarns. The construction of the fabric commonly ranges from 10 picks per inch to approximately 30 picks per inch and from 18 ends per inch to approximately 40 ends per inch. But construction is not limited to the given ranges as long as the maximum open area does not exceed 7 percent.

Polypropylene is commonly the preferred and accepted polymer used in the the scrim, but polyester, nylon and other materials hold certain advantages. Polypropylene is currently used in the primary backing fabric, but other know materials have application in this system as they may improve the mechanical and thermal properties of the primary backing. Production of a woven scrim is also not limited to a plain weave, but it is the commonly accepted weave for this application. Other weave types provide certain advantages in terms of improved processability during manufacture of the scrim. The slit tape yarns are commonly used in the scrim due to cost consideration and to achieve the necessary coverage to limit open area to no more than 7 percent. Other type yarns may be employed to enhance performance characteristics of the scrim without jeopardizing the fabric coverage.

The preferred construction of the woven fabric is about 13 to 18 picks per inch by 24 to 32 ends per inch in a plain weave configuration. The dimensions of the fill yarn are about 1.5 to 2.5 mills in thickness by 90 to 100 mils in width. The dimensions of the warp yarn are about 0.8 to 2 mils in thickness by 40 to 50 mils in width. The preferred yarns are highly annealed to reduce shrinkage properties and the woven fabric may be heatset at approximately 280° F. fabric temperature for a period of about 15 to 45 seconds.

Conventionally woven primary backing fabrics typically have tucked selvages, which are provided to prevent raveling of the lateral ends. A problem is created with this technique in that the edges have slightly greater thickness than the area between the ends. Although the variation may not be observable in a given length of fabric, when a roll of fabric is manufactured, continuous lengths of approximately 1500 yards are formed and shipped to carpet manufacturing facilities, or other depending upon the eventual use of the fabric. A roll of such fabric, according to the prior art, is depicted in FIG. 1 by the numeral 20. Roll 20 is wound onto a take-up spool 21 and typically has a length of approximately 10 to 15 feet and a width of up to about three feet in diameter, depending upon the size of the weaving loom. Because of the build-up in the selvage areas 22, the diameter 23 of the ends is greater than the diameter 24 across the general width of the roll 20.

Figure 2:
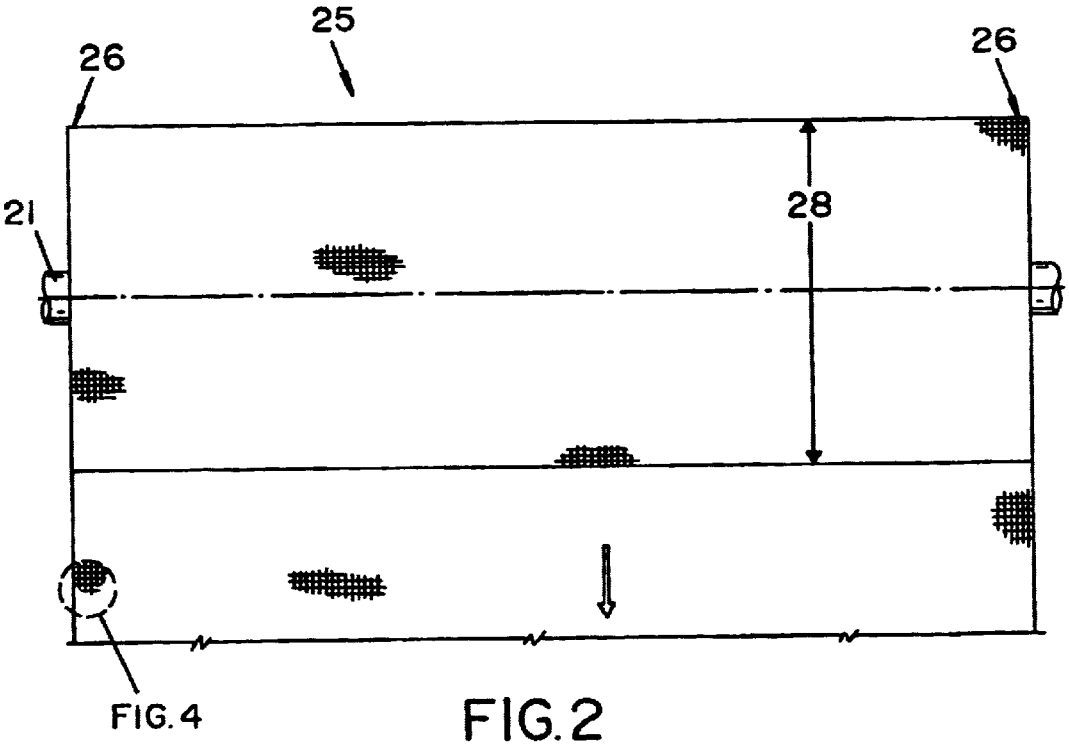
FIG. 2 is top plan view of a roll of woven fabric, according to the present invention.

In contrast, a roll of woven fabric, according to the present invention, is depicted in FIG. 2 by the numeral 25. Roll 25 is wound onto a take-up spool 21 and typically has the lengths and widths of the roll 20. Because there is essentially no build-up in the selvage areas 26, the diameter 28 across the general width of the roll 25 is the same at the ends. Measurements made of the fabric roll produced according to the present invention reveal a decrease in selvage area diameter of approximately 56 percent compared to conventionally woven fabric rolls in which every weft cord is tucked. The effect of the more uniform diameter is to provide less gain in the pattern of the carpet that is tufted into the primary fabric. Hook measurements taken on fabric rolls according to the present invention are also lower, which further facilitates straighter patterns in the final carpet.

Figure 3:
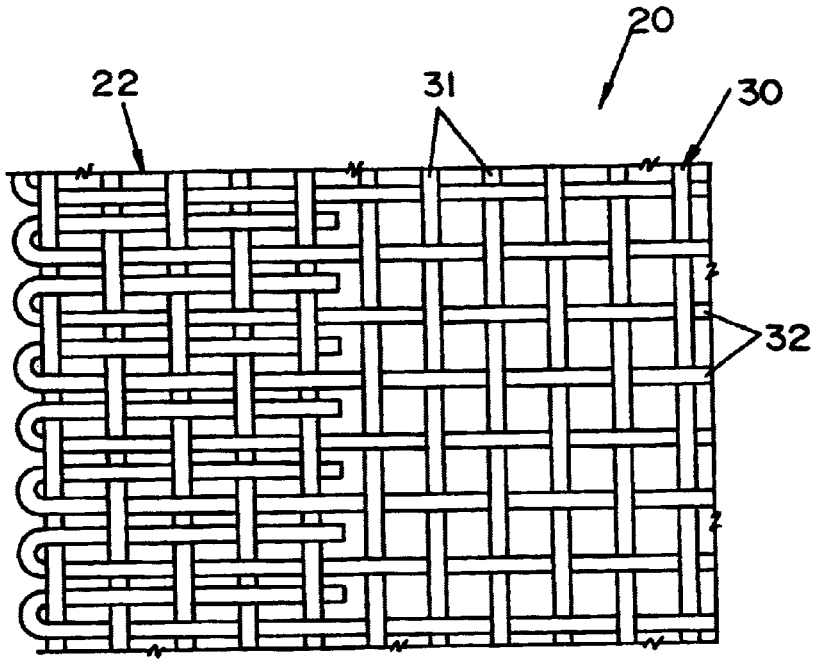
FIG. 3 (PRIOR ART)
FIG. 3 is an enlarged cross-section of the circular area in FIG. 1, depicting a fully tucked selvage.
Figure 4:
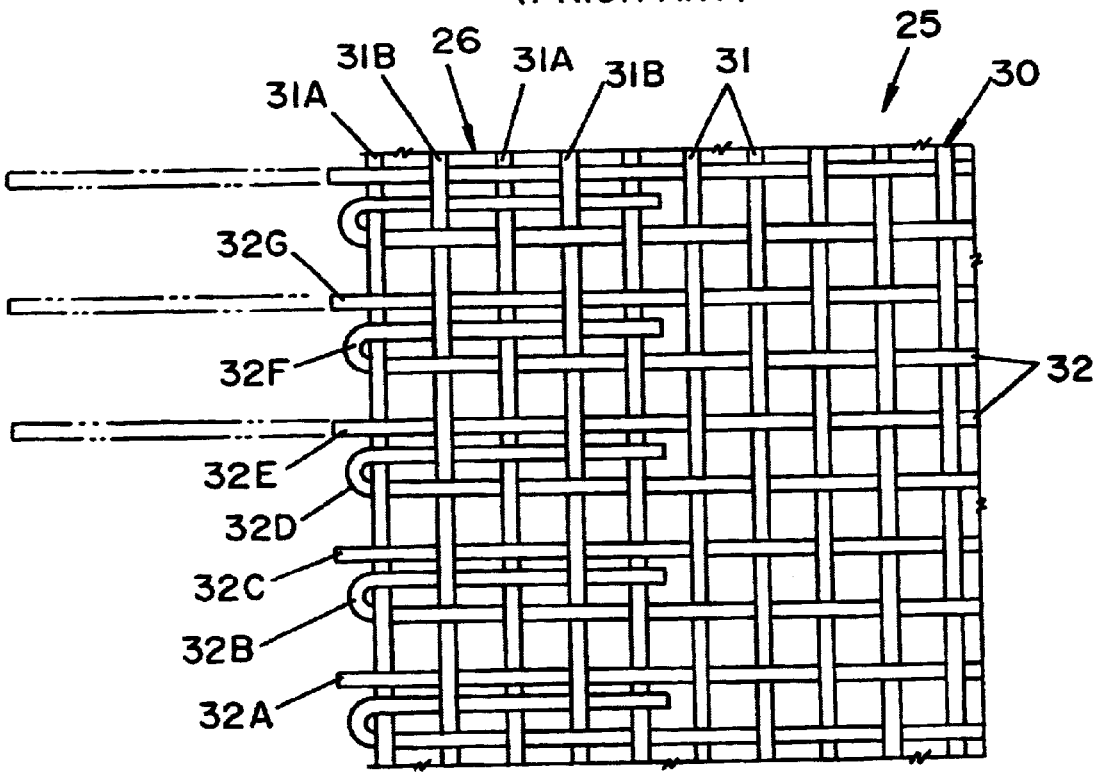
FIG. 4 is an enlarged cross-section of the circular area in FIG. 2, depicting a tucked-untucked selvage according to the present invention.

With reference to FIGS. 3 and 4, the fabric 30 will be considered and the respective ends 22 and 26. FIG. 3 depicts the fabric 30 according to the prior art, which comprises a plurality of warp yarns 31, interwoven with a plurality of weft yarns 32. At the end 22 depicted, the ends of each weft yarn have been tucked back into the fabric, which is a conventional operation on a weaving loom. Significant to the understanding is that every yarn end is tucked to produce a uniform edge.

In FIG. 4, the fabric 30 according to the present invention again comprises a plurality of warp yarns 31, interwoven with a plurality of weft yarns 32. At the end 26 depicted, the ends of every other weft yarn e.g., 32D, 32F, have been tucked back into the fabric, leaving the remaining alternating ends e.g., 32C, 32E, 32G and the like untucked. The untucked lines appear in phantom because although they extend beyond the end 26 of roll 25, they can be trimmed away to produce a uniform edge, if desired.

Figure 5:
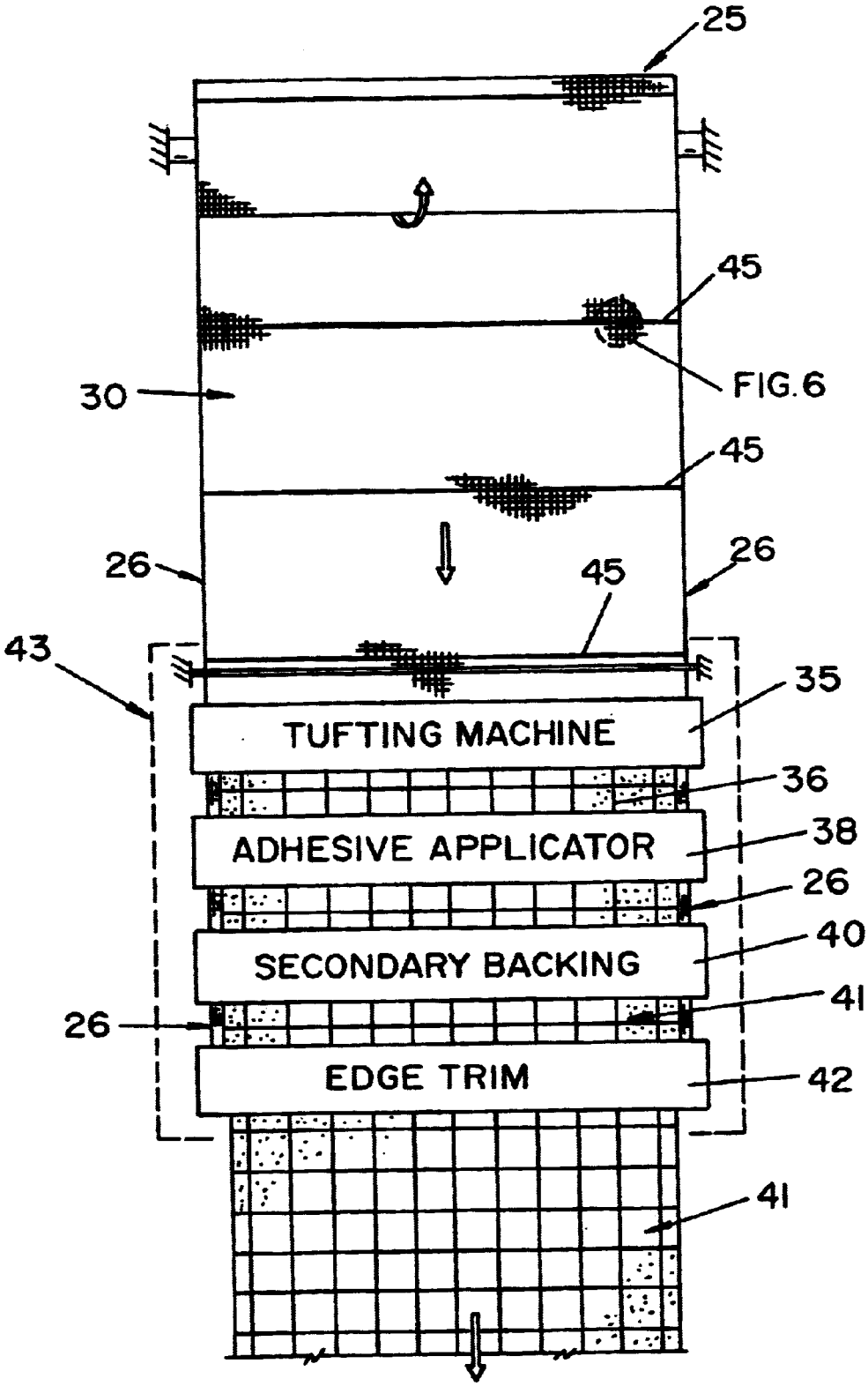
FIG. 5 is a top plan view, depicting a roll of primary backing fabric of the present invention, passing through various operations schematically, in the manufacture of tufted broadloom carpet.

With reference to FIG. 5, a schematic depiction of the manufacture of carpet shall be discussed. As is conventionally done, the primary backing fabric 30 if fed from a roll 25 into the carpet tufting apparatus, indicated generally by the numeral 35, where the face yarns are applied that will define the appearance and walking surface of the carpet. After the face yarns 36 have been applied, the next operation is application of the adhesive, indicated generally by the numeral 38. The adhesive, applied to the underside of the primary backing 30, is usually a latex binder or the like, as is conventionally known. After the adhesive is applied, the secondary backing is applied, to the underside of the primary backing 30, indicated generally by the box 40. The backing contains the latex adhesive, further securing the face yarns 36 and strengthening the carpet, now indicated by the numeral 41. As a final operation, the carpet 41 can optionally be subjected to an edge trimming stage, indicated by the box 42. As is typical, the tufting does not extend to the edges of the fabric 30 or the selvages 26. These are utilized for gripping of the developing carpet and transporting it through the overall carpet manufacture equipment, indicated generally by the numeral 43.

Figure 6:
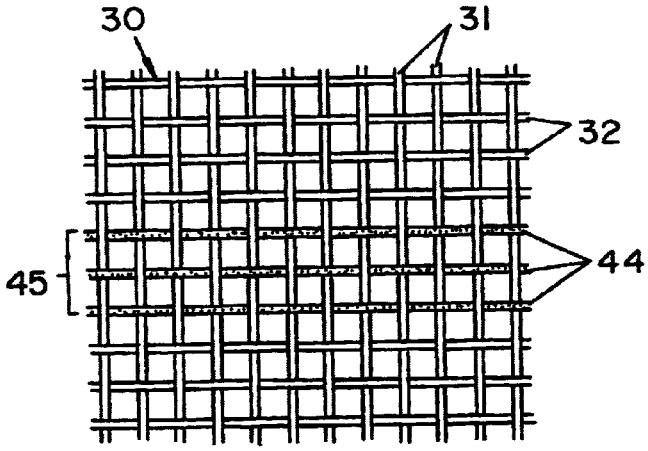
FIG. 6 is a partial enlarged plan of the circular area in FIG. 5, depicting the presence of contrasting pick lines, according to the present invention.

As noted hereinabove, a feature of the fabric 30 of the present invention, is the provision of one or more weft, or pick lines, that have a contrasting color, such as depicted in FIG. 6 by the numeral 44. Although three have been depicted as exemplary, it is to be understood that any number from one to more than three could be woven into the fabric to provide a contrasting line 45 across the width of the fabric 30, in the cross-machine direction. The purpose of the line 45 is to provide the equipment operator a visual alignment, generally parallel to the carpet manufacturing equipment 43, while the primary fabric is fed through during carpet manufacture. In this manner, the perpendicularity of the fabric can be monitored, providing an assurance to the operator that all of the pick yarns are essentially perpendicular to the warp yarns.

Figure 7:
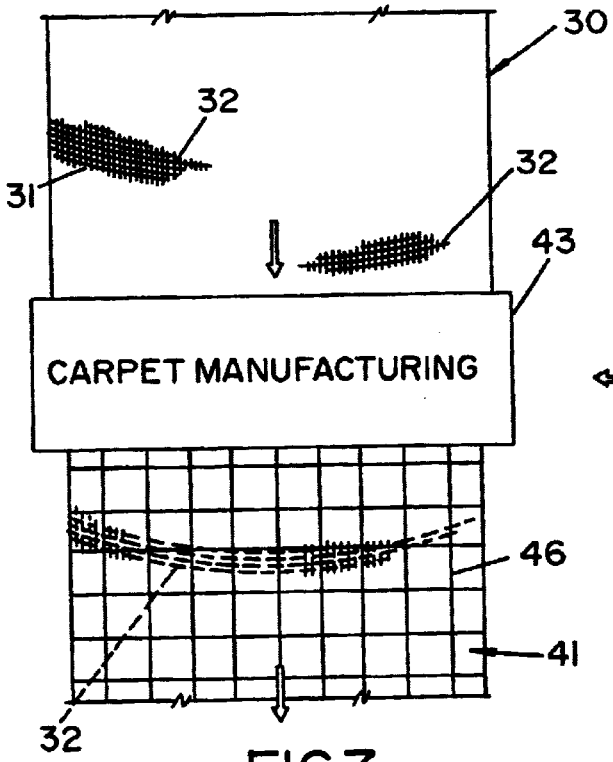
FIG. 7 (PRIOR ART)
FIG. 7 is a top plan view, depicting a roll of primary backing fabric of the prior art and having a bowed pick line, passing through the carpet manufacturing operations of FIG. 5 and a resulting section of broadloom carpet.
Figure 8:
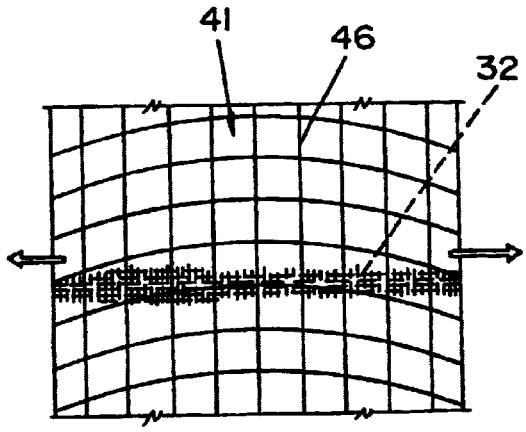
FIG. 8 (PRIOR ART)
FIG. 8 is a top plan view, depicting a resulting section of broadloom carpet, manufactured according to FIG. 7, after the carpet is stretched during installation.

To illustrate the problems in the existing art, bowing of the fabric 30 has been depicted in FIGS. 7 and 8. Bowing occurs where the ends of the fill (weft) yarn 32 are basically at the same distance along the lengths of the fabric 30, but the fill yarn between the edges gains or loses in distance along the length, which has the result of bending or curving the pick lines. While an operator normally cannot see this occurring, carpet manufacture continues. The pattern that is formed, which can be based on texture, or color, or both, is indicated by the squares 46 on the carpet 41. In FIG. 8, when the carpet is installed and stretched, the primary fabric is straightened, at which time the pattern 46 is bowed or otherwise distorted from the intended appearance.

Figure 9:
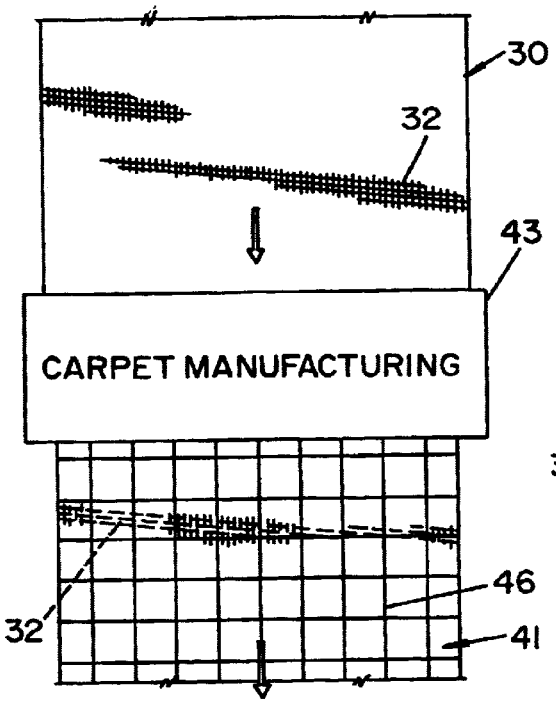
FIG.9 (PRIOR ART)
FIG. 9 is a top plan view, depicting a roll of primary backing fabric of the prior art and having a skewed pick line, passing through the carpet manufacturing operations of FIG. 5 and a resulting section of broadloom carpet.
Figure 10:
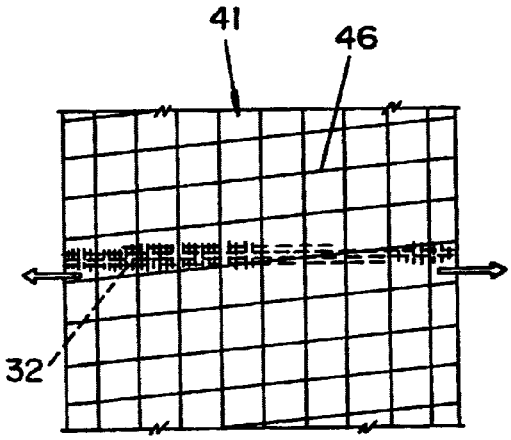
FIG.10 (PRIOR ART)
FIG. 10 is a top plan view, depicting a resulting section of broadloom carpet, manufactured according to FIG. 9, after the carpet is stretched during installation.

To illustrate another problem in the existing art, skewing of the fabric 30 has been depicted in FIGS. 9 and 10 to depict. Skewing occurs where the fill (weft) yarn 32 is basically straight, but one end of the fill yarn gains or loses along the length of the fabric 30, in which instance the primary backing fabric does not pass perpendicularly through the apparatus 43. While an operator normally cannot see this occurring, carpet manufacture continues. The pattern 46 that is formed on the carpet 41 is not aligned with the fabric 30 and thus, when the carpet is installed and stretched, FIG. 10, the primary fabric is straightened, at which time the pattern 46 is also skewed or otherwise distorted from the intended appearance.

The intermittently spaced fill yarns of contrasting color is preferably comprised of fill yarns with dimensions of about 1.5 to 2.5 mils in thickness by 90 to 100 mils in width (same dimensions as the other fill yarns in the fabric). The width of the contrasting pick line formed may be from 1 to 20 fill yarns, but is preferably about 3 fill yarns. The distance between the contrasting pick lines may range from 1 inch to 30 feet, but is preferably about 36 inches. The color of the pick line may be any color that is perceptively contrasting within the woven fabric. The width of the pick line should be wide enough to ensure that it is detectable in relatively fast moving carpet manufacturing process, but no so wide as to mask the pick line path in contrast to the areas between colored pick lines. The distance between the pick lines must be far enough to prevent "bleeding" together in the faster processes, but close enough to allow for frequent checks in the slower process (including weaving).

Although color can be utilized to produce a contrasting line 45, the present invention is not so limited. Other than visual means, a contrasting pick, or weft, line according to the present invention shall also include pick lines that can be detected by some other means such as, for example, magnetically. Accordingly, any detectable means, visual or machine-readable, can be employed to achieve the same desired purpose of a contrasting line.

Another technique for reducing thickness of the selvage is to employ warp yarns of reduced denier in the selvage area. Preferably, warp yarns with dimensions of about 0.99 to 1.17 mils in thickness by 42 to 46 mils in width are employed. The preferred reduction in yarn denier from the body warp yarns to the selvage warp yarns is about 22.5 percent.

It is to be understood that bowing and skewing are also caused by the increased selvage thickness rather than merely adjustment of the equipment or lack of attention by the operator. While the line 45 is an aid to controlling the equipment and eliminated bowing or skewing before a large area of carpet is produced, the remainder of the present invention is directed toward an assembly utilized on the existing weaving loom to control the selvage thickness. By use of the assembly and method of the present invention, tucked-untucked filling tails of the selvage are produced by mechanically removing every other fill yarn from the tucking needles on each selvage.

Figure 11:
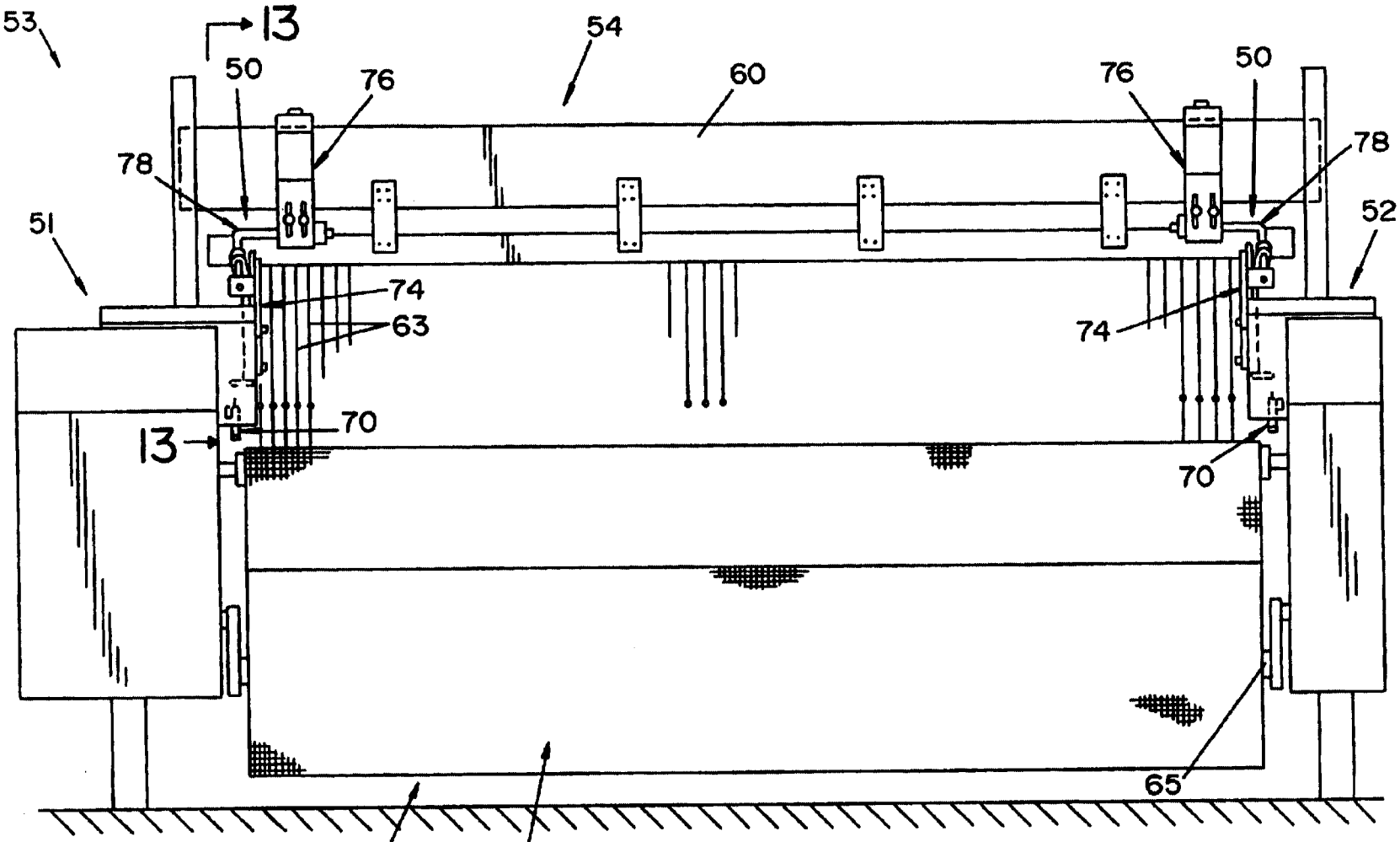
FIG. 11 is an elevation of a conventional weaving loom with the assembly of the present invention for producing a tucked-untucked selvage in woven fabric.

The assembly, indicated generally by the numeral 50, is mounted on the picking and receiving ends, 51 and 52 respectively, of a loom, generally 53, depicted in FIG. 11. The loom 53 can be of the projectile, rapier or air jet type, that is, any loom that requires a pick to be tucked into the next shed. A typical projectile loom is manufactured by Sulzer-Ruti, although practice of the present invention is not limited to this particular loom. The loom 53 has a front 54 and a rear 55 and provides a plurality of harnesses, two being shown in FIG. 12, 60 and 62. The harnesses carry a plurality of heddles, 63 and 64 respectively, which carry individual warp yarns, 31 in heddles 63, moved by harness 60 and in heddles 64, moved by harness 62. A roll of fabric 25 is shown at the rear, or take up end of the loom 53, wound onto a core shaft 65.

Figure 12:
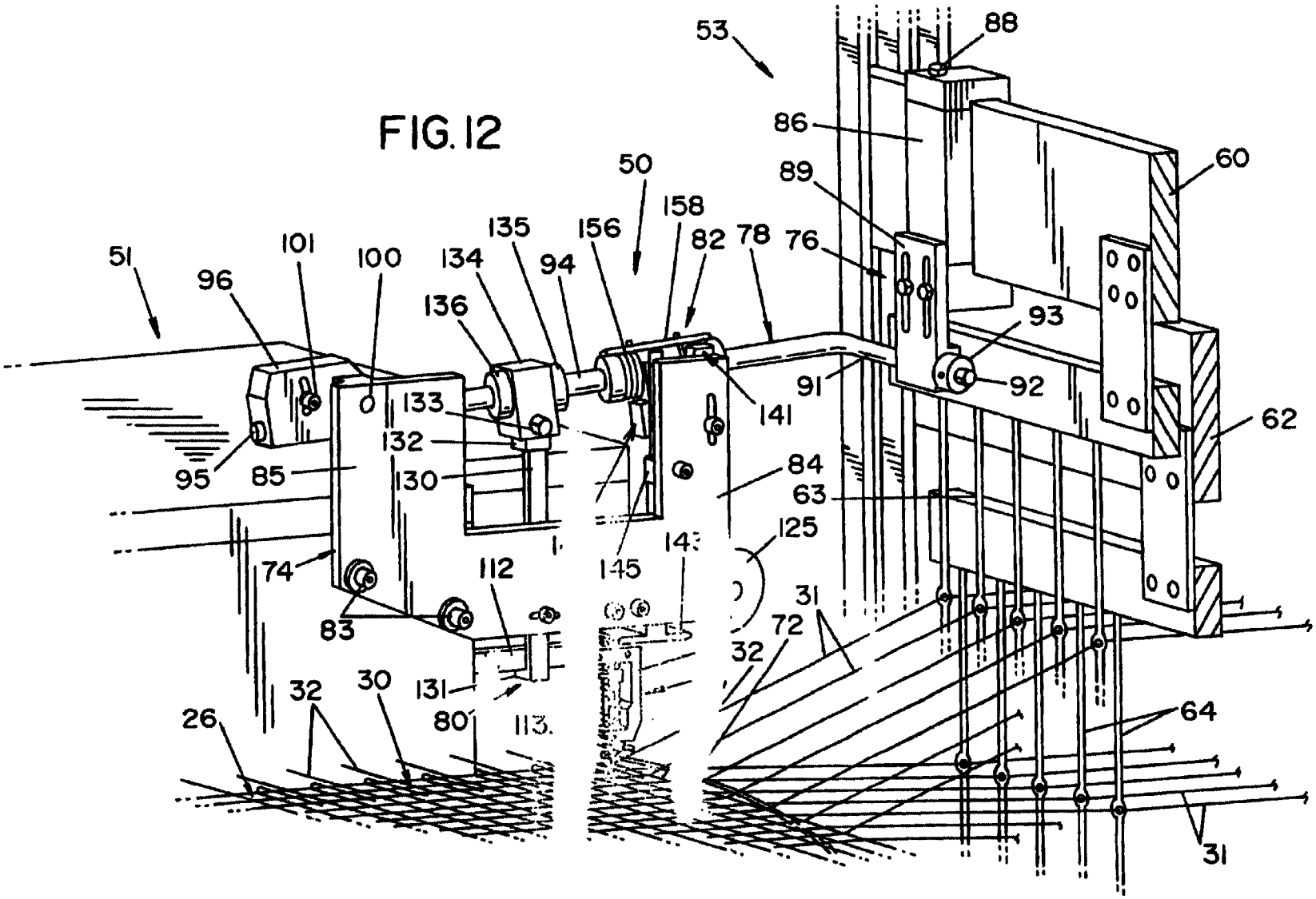
FIG. 12 is a partial perspective view of the assembly of the present invention at the picking side of the loom of FIG. 11.

In FIG. 12, the picking side 51 of a loom 53 is presented upon which the assembly 50 of the present invention is depicted as mounted. Inasmuch as the woven fabric 30 has opposed selvages 26, it is to be understood that an assembly 50 will also be employed on the receiving side of the loom 53. Because the assemblies are identical in construction and operation, the present invention will be described to reference to the picking side. As is known with this type of loom, a weft end gripper, generally 70, is employed at the picking and receiving sides of the loom, the purpose of which is to grip the end of an inserted weft end (pick line) 32, to bring it into the fell of the fabric and to hold it. Concurrently, the tucking needle 72 is moved from beneath the fabric to grab the severed weft end and draw or tuck it into the selvage 26.

The tucked end e.g., 32B (FIG. 4) is inserted into the next shed, as the harnesses 60 and 62 reverse—harness 60 lowers, while harness 62 raises—to reside in the next shed occupied by the subsequent weft yarn 32C, and so forth. At this point it is to be understood that the weft gripper 70, tucking needle 72 and related mechanisms for tucking a severed weft yarn is clearly known in the art and need not be described. Likewise, the movement of the harnesses, controlled by a dobby (not shown) to provide the desired weave pattern is also known. As each subsequent weft yarn or pick line 32 is inserted between the warps 31, it is beat into the fabric by a reed, which has been removed for the sake of clarity. The reed, also known, is a bar that extends across the width of the fabric which forces each new weft yarn firmly into and between the crossed warp yarns before the harnesses reciprocate, locking that pick line into the weave.

The assembly 50 of the present invention operates to prevent every other pick line from being tucked, so that the selvage area comprises alternating tucked weft ends (32B, 32D, 32F and so) and untucked weft ends (32A, 32C, 32E and so), thereby reducing the thickness of the selvage 26. The working mechanism of assembly 50 is primarily visible from the opposite side and reference should now be made to FIG. 13, for a more complete description. The assembly 50 comprises plate means, generally 74; main drive block means, generally 76; operating rod means, generally 78; lifter means, generally 80; and means for selectively engaging the weft end gripper, generally 82.

The plate 74 is made of metal and is affixed to the loom via machine screw 83, or the like. It is a generally U-shaped component having inboard and outboard legs, 84 and 85 respectively. It is essentially the frame of the assembly 50, carrying several of the other components, as will be described. The main drive block means 76, is connected to a harness of the loom, generally the first harness 60. It includes a bracket 86 which is clamped to the harness 60 via bolt 88. At the lower end of bracket 86, a clamp block 89 is affixed and it is provided with a bore 90 (FIG. 15) for receipt of the operating rod means 78.

Figure 16:
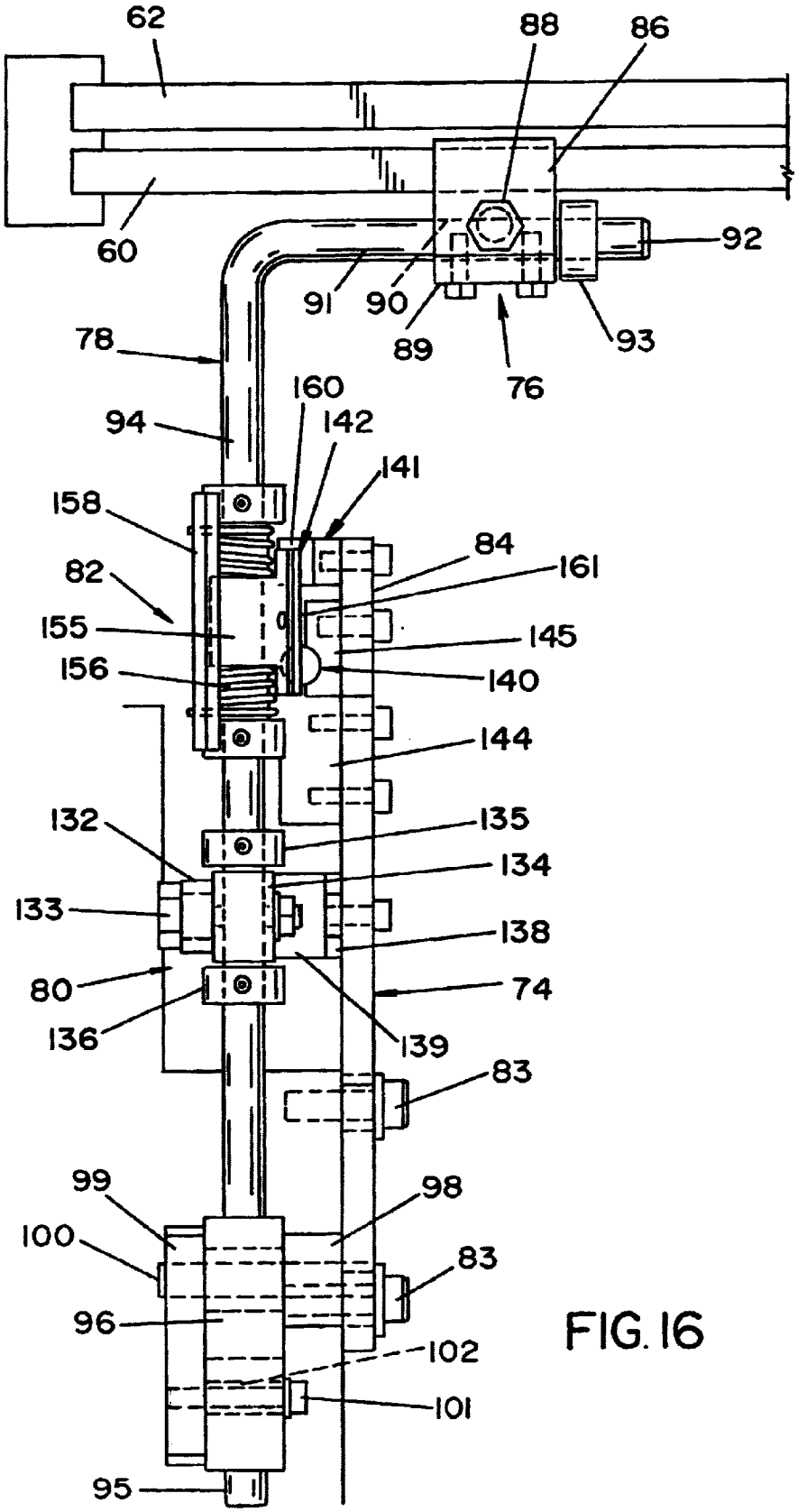
FIG. 16 is a top plan view of the assembly of the present invention for producing a tucked-untucked selvage in woven fabric.

The operating rod means 78 is an L-shaped rod (FIG. 16), the shorter leg of which, 91 provides a first end 92 that is received in the bore 90 so as to be rotatable therein. A locking collar 93 maintains the rod within the bore 90. The longer leg 94 of operating rod means 78 is engaged by the lifter means 80 and means for selectively engaging the weft end gripper, 82, as will be described below. The far end 95 of leg 94 is held within a guide piece 96, affixed to the plate 74 via pin 100, passing through a spacer block 98. On the face of guide piece 96, an adjusting plate 99 is provided which is pivotally affixed to the guide piece 96 around pin 100. A machine screw 101 passes through the rear of guide piece 96, in an arcuate slot 102, into the adjusting plate 99 to allow for positioning of the operating rod means 78. As can be appreciated from FIG. 13, as the harness 60 raises and lowers, the longer leg 94 of the operating rod means 78 pivots radially about the pin 100.

Before proceeding further with the description of the assembly 50, the weft end gripper 70 will be discussed with reference to FIGS. 12, 13 and 15. As noted hereinabove, this mechanism is employed on looms at the picking and receiving ends to tuck the severed weft yarns into the selvage area of the fabric, in order to prevent raveling and it operates in conjunction with the tucking needle 72, shown in FIG. 15.

With each cycle of the projectile (not shown) the weft yarn is fed between the shed of warp yarns. The projectile releases the yarn while the weft end gripper at the receiving end of the loom grabs it. Concurrently, the yarn is severed at the picking end and the weft end gripper at the picking end of the loom also grabs it. Inasmuch as both grippers are the same, the receiving end shall be described. The gripper 70 comprises a generally C-shaped anvil 111, which is affixed to a reciprocating lever 112, itself driven by a known mechanism in the loom (not shown). As depicted in FIG., 13, the lever 112 moves outwardly from the interior of the loom and slightly downwardly within a cycle and then returns.

The gripper 70 provides a shoe 113 that is affixed to a shoe rod 114 that passes through opposed bores in the anvil 111. The upper and lower ends of the rod 114 project through the anvil and the shoe is carried beneath the anvil. The shoe 113 is movable with respect to the anvil base 115 to provide a clamp, generally 116 for the weft yarn. A compression spring 118 encircles the rod 114 to urge the shoe against the base 115 except when the upper projection of the rod is pushed downwardly against the anvil and the clamp 116 is opened. An auxiliary spring rod 119 is also provided adjacent the shoe rod 114. It projects through a bore in the upper end of the anvil 111 and a bore provided in the lip 120 at the lower end of the anvil. A compression spring 121 encircles the rod 119 to provide greater clamping on the weft yarn. An adjustable collar 122 is also provided, through which both rods pass.

The compression spring 121 is stronger than the spring 118 and the two springs act together to enable the weft end gripper 70 to grip the end of the pick line 32, delivered by the projectile, securely to bring it into the fell of the fabric (between the upper and lower warp yarns 31B and 31A, prior to beating) and hold it there. The tucking needle 72 passes between the upper and lower warp yarns and a hook 124, at the end, grabs the pick line 32, drawing it into the fell, or shed.

Figure 13:
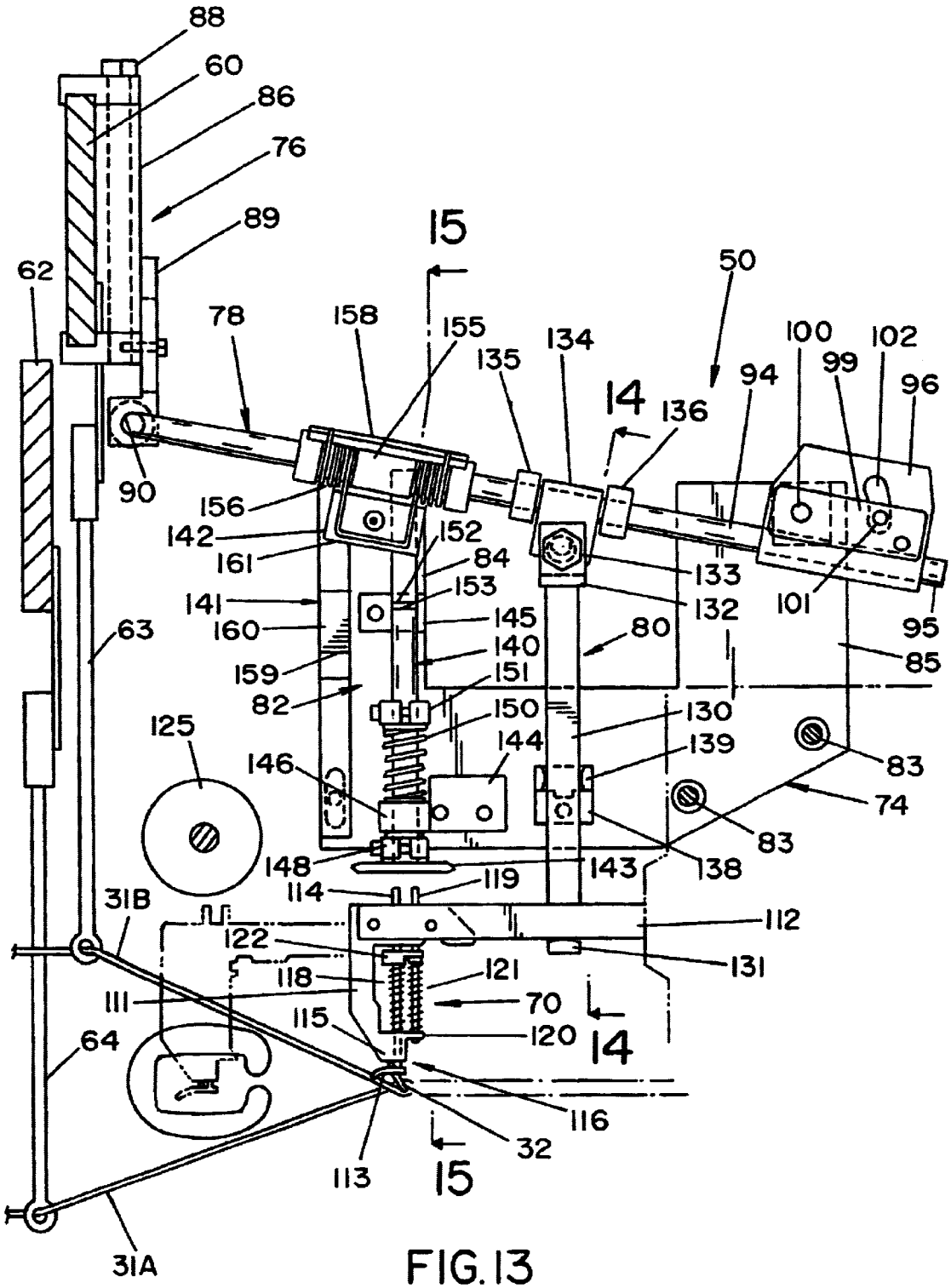
FIG. 13 is a side elevation, taken along lines 13—13 of FIG. 11, of the assembly of the present invention for producing a tucked-untucked selvage in woven fabric.

In actual operation, the gripper 70 is extended to the phantom position in FIG. 13, where it grabs the pick line. It first passes under a front roller 125, as it is extended by the lever 112 and when it encounters the roller, the two rods 114 and 119 are depressed, opening the clamp 116 to grasp the yarn. The lever then travels downwardly, taking the gripper 70 away from the roller 125 where the combined action of the springs 118 and 121 secure the pick line as the gripper is then drawn rearwardly, into the shed. In normal operation of the loom, the gripper 70 passes under a second, or rear roller which works against the rods 114 and 119 for controlled release of the pick line 32. When the assembly of the present invention is employed, the rear roller is replaced, which it why it does not appear in the drawings.

As soon as the tucking needle 72 begins to tuck the severed yarn end, the rear roller first engages the spring rod 119 and releases the strong spring 121. Generally, the clamp 116 is beginning to open also, so that the tucking needle can draw the pick line 32 out of the gripper and proceed to tuck it into the shed with the next pick line that is fed and placed (FIG. 3). It is the design of the loom that this weft end gripper with two springs is employed and as such practice of the present invention is not limited by the gripper, tucking needle or other aspects of tucking severed pick lines into the selvage. Again, during normal operation of the loom, with each cycle of the loom a pick line is fed between alternating warp lines, severed at both ends and then tucked into the selvage.

The assembly of the present invention alters this cycling so that every other pick line is not tucked hence, a tucked-untucked selvage is developed. It was previously noted that the assembly 50 is operable on the loom with the rear roller (for engagement of the weft end gripper) removed. Accordingly, a means 82 for selectively engaging the weft end gripper is brought into contact with the gripper 70, as will be explained subsequently.

Figure 14:
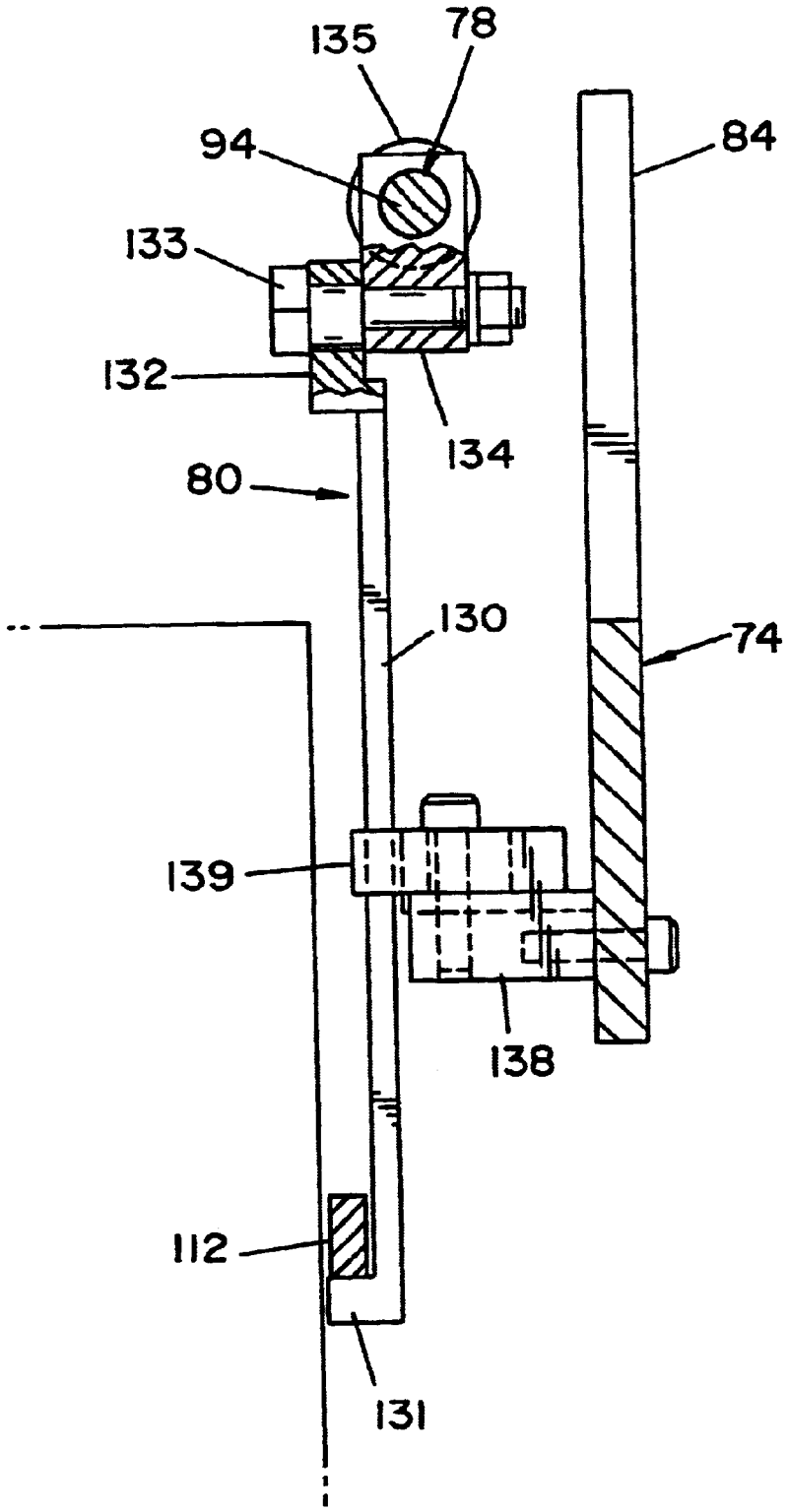
FIG. 14 is a rear section, taken substantially along the lines 14—14 of FIG. 13.

First, the lifter means 80 will be described. With specific reference to FIGS. 13 and 14, the lifter means 80 comprises a lifter bar 130, terminating in a lower foot 131 which forms a shelf or ledge for the support of the lever 112 associated with the weft end gripper 70. At the upper end of the lifter bar an offset bracket 132 is provided which is connected by bolt 133 to a lifter drive block 134, rotatably mounted on the operating rod means 78 and secured between two collars 135, 136. At this point it will be noted that as the operating rod 78 moves with the harness 60, the lifter means 80 raises and lowers the weft end gripper 70. Affixed to the plate 74 is a guide support 138, to which a lifter guide 139 is mounted, causing the lifter means 80 to reciprocate vertically. Also aiding in this movement is a pivotal movement between the offset bracket 132 and the lifter drive block 134, about the bolt 133.

Figure 15:
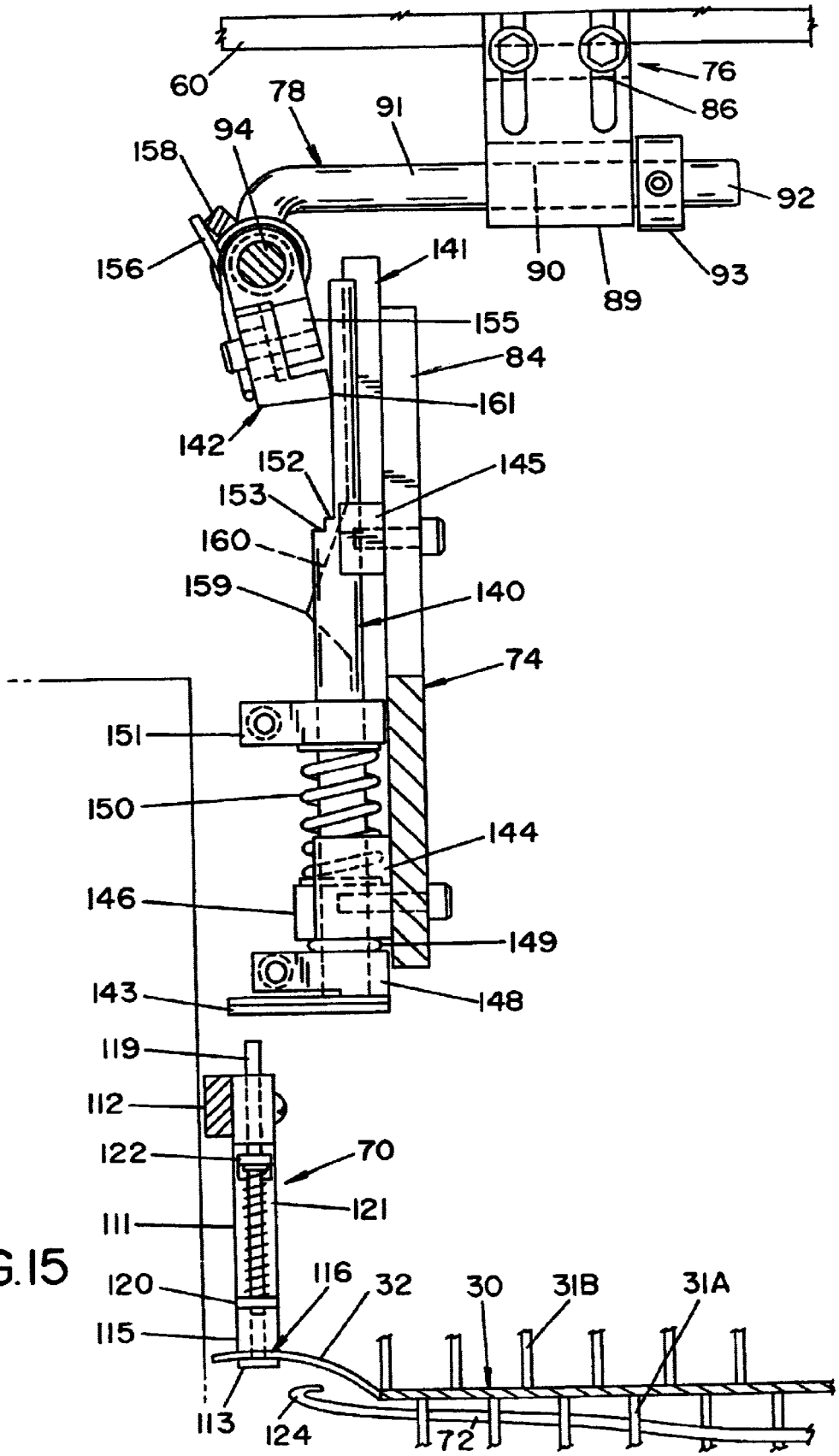
FIG. 15 is a rear section, taken substantially along the lines 15—15 of FIG. 13.

The means 82, for selectively engaging the weft end gripper 70 is depicted in FIGS. 13 and 15. Means 82 broadly includes an opener shoe rod 140, a disengagement means 141 and an opener ratchet block 142. The shoe rod 140 and disengagement means 141 are carried by the plate 74 rather than the operating rod 78. Shoe rod 140 carries at its lowermost end an opener shoe 143, which is periodically brought into contact with the spring rods 114 and 119 of the weft end gripper 70, replacing the rear roller of the loom, normally provided. Shoe rod 140 is mounted between and supported by lower guide block 144 and upper guide 145. Lower guide block 144 provides a hub 146, having a cylindrical bore through which the shoe rod passes, allowing it move vertically.

Between the lower guide block 144 and the opener shoe 143 is clamping guide block and O-ring, 148 and 149 respectively. A spring 150 encircles the shoe rod 140 and is fixed against a collar 151. Along the upper third of shoe rod 140 are first and second steps, 152 and 153 respectively, the two being separated by approximately one millimeter. As is evident in FIG. 15, when the opener ratchet block 142 moves downwardly with the operating rod 78, it eventually contacts the first step 152 and thereafter urges the shoe rod and opener shoe 143 down into contact with the spring rods 114 and 119 of the selvage gripper. As this movement occurs, the spring 150 is compressed between the hub 146 of lower guide block 144 and collar 151 so that the shoe rod is usually raised above the selvage gripper 70 when harness 60 and the operating rod 78 are up.

The opener ratchet block 142 is affixed to carrier 155 which has a bore through which the operating rod 78 passes and a latch spring 156 which provides opposed coils on either side of the carrier. The carrier is positioned on the rod 78 by a double clamp bracket 158 which extends beyond the coils of latch spring 156. With this arrangement, the ratchet block 142 is rotatably biased counter-clockwise, as viewed in FIG. 15, to maintain contact with the shoe rod 140.

In FIG. 13, it is apparent that the harness 60 eventually moves downward to the same plane as harness 62 which, in turn, moves upward to the plane in which harness 60 is shown. This movement provides a corresponding vertical reciprocation of the operating rod 78 and components mounted thereon. Because the opener shoe 143 is only required to move a lesser distance to contact the rods 114 and 119 of the gripper 70, the means for selectively engaging, 82, also provides for some lost motion with the disengagement means 141. The means 141 is attached to the plate 74 and does not move with respect to it or the operating rod 78.

As best viewed in FIG. 15, the disengagement means 141 is adjustably affixed to the plate 74 and is a generally rectangular rod, carrying a cam 159 in approximately the middle third of its length. The cam 159 provides a sloping surface 160 which extends away from the rod. The surface 160 commences its extension from the rod just below the first step 152 of the shoe rod 140, continues along the second step 153 and eventually terminates at an apex that extends beyond the diameter of the shoe rod 140. Thus, as the operating rod 78 and ratchet block 142 move downwardly, the pawl 161 of the block is eventually rotated out of engagement with the first and second steps and then the shoe rod entirely so that the shoe rod can retract while the block 142 concludes its travel.

Although the disengagement means 141 is depicted in the form of a rod carrying the cam 159, it is to be appreciated that the cam could also be directly and adjustably affixed to the plate 74 without a rod and still perform the same function.

Figure 17A:
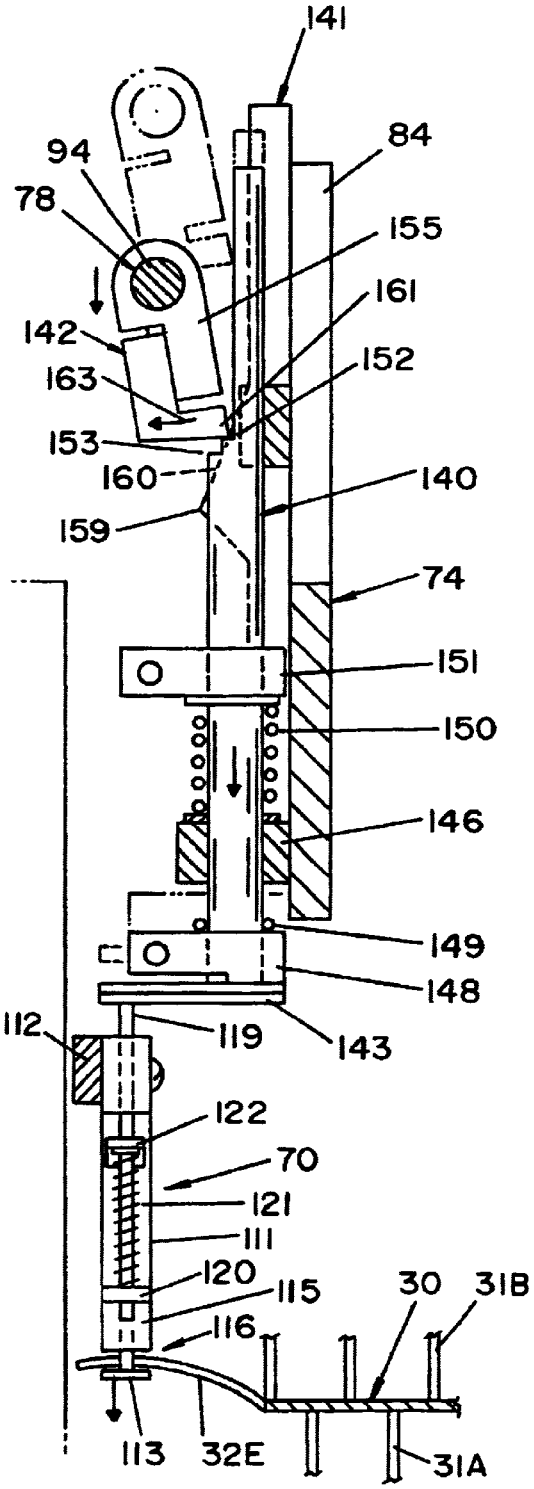
FIG. 17A is a schematic rear section, taken substantially along the lines 17A—17A of FIG. 18D.
Figure 17B:
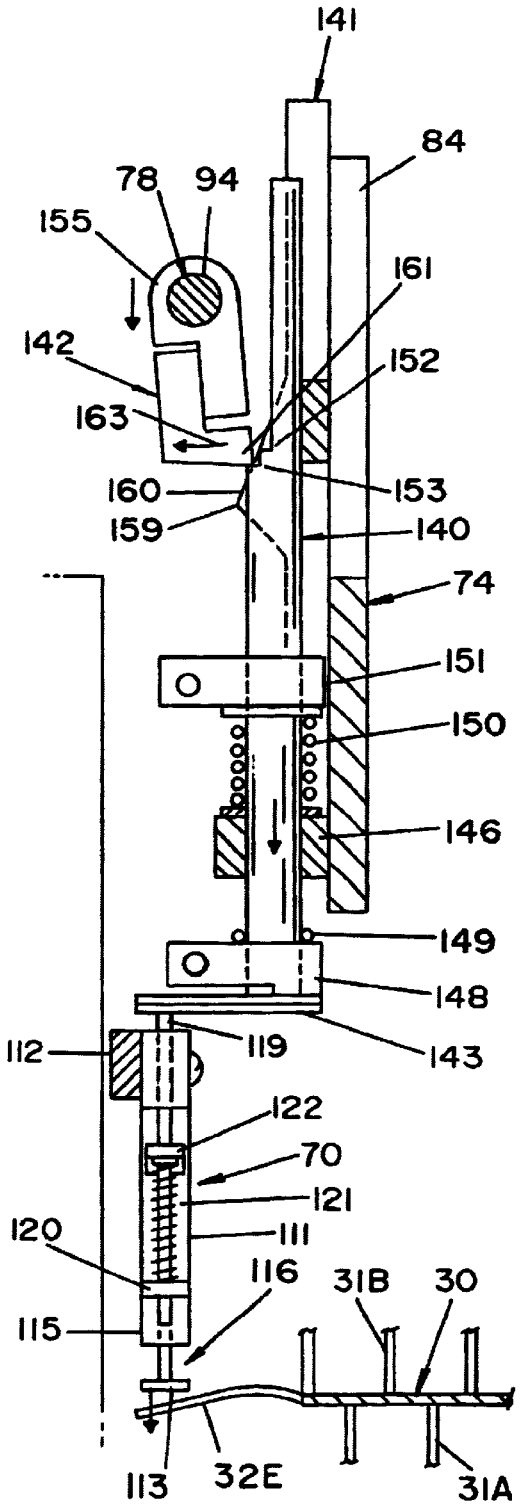
FIG. 17B is a schematic rear section, taken substantially along the lines 17B—17B of FIG. 18E.

With reference to FIGS. 17A and 17B, this motion can be followed schematically. In FIG. 17A, the pawl 161 is moving downwardly and engages the first step 152 to push the shoe rod 140 down. As this occurs, the opener shoe 143 engages the rods 114 and 119 of the gripper 70. As downward movement continues, the pawl 161 also contacts the cam 159 which rotates the pawl clockwise in the direction of arrow 163 where it is caught by the second step 153 (FIG. 17B), at which stage the clamp 116 is opened approximately one millimeter. As will be explained subsequently, with the clamp partially open, the pick line 32 is not held and as the gripper 70 is subsequently extended by the loom, the pick line is freed. As shown here, it was also not contacted by the tucking needle 72. Continued downward movement of the pawl 161 results in its rotation out of contact with the shoe rod 140 whereupon the spring 150 encircling the rod forces the shoe rod up and out of engagement with the selvage gripper. As soon as both rods of the gripper are free of the shoe, their respective springs cause the clamp 116 to close.

Figure 18A:
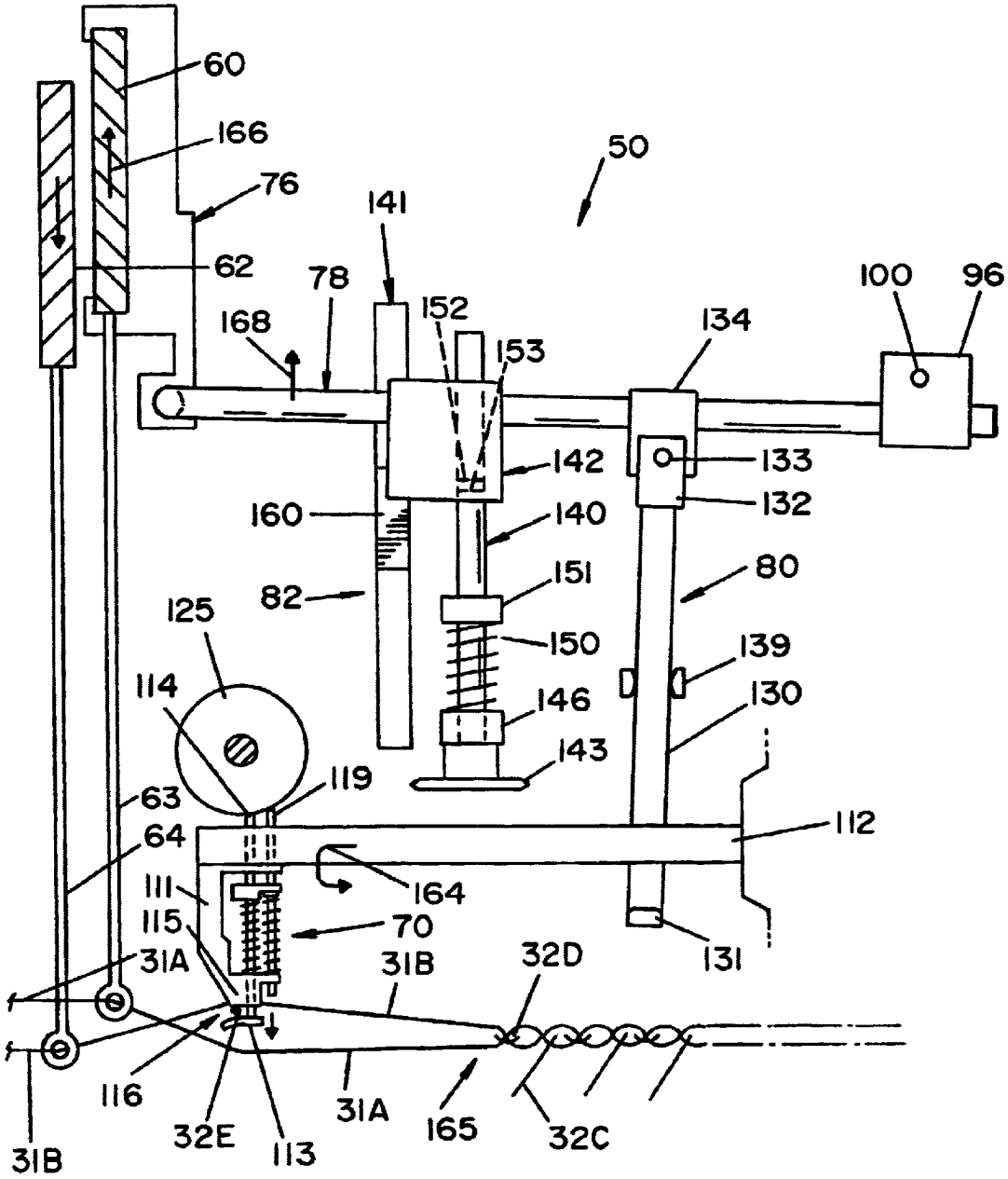
FIGS. 18A–18H are a series of schematic views depicting portions of the assembly, according to the present invention, during sequential stages of operation and the woven fabric passing therethrough, in enlarged cross-section.

With reference now to FIGS. 18A–18H, the complete operation of the assembly can be described. Most weaving looms function in a 360° cycle, whereby one pick line is placed severed and tucked. The assembly 50 operates by allowing one warp yarn end to be tucked in a cycle while the next warp yarn end, in the subsequent cycle is untucked and so forth. In FIG. 18A, at 350° in the cycle, the selvage gripper 70 has been extended forward (to the left in these figures) where it has just grabbed a weft yarn 32E. As the gripper lever 112 begins to retract the gripper 70, in the direction of the arrow 164, the spring rods 114 and 119 are clearing the front roller 125, closing the clamp 116, to bring the yarn 32E into the shed, indicated by the numeral 165. It will be observed that the previous warp yarn 32D has been tucked. As the harness 60 travels upwardly, arrow 166, the operating rod 78 is also driven upwardly, arrow 168.

Figure 18B:
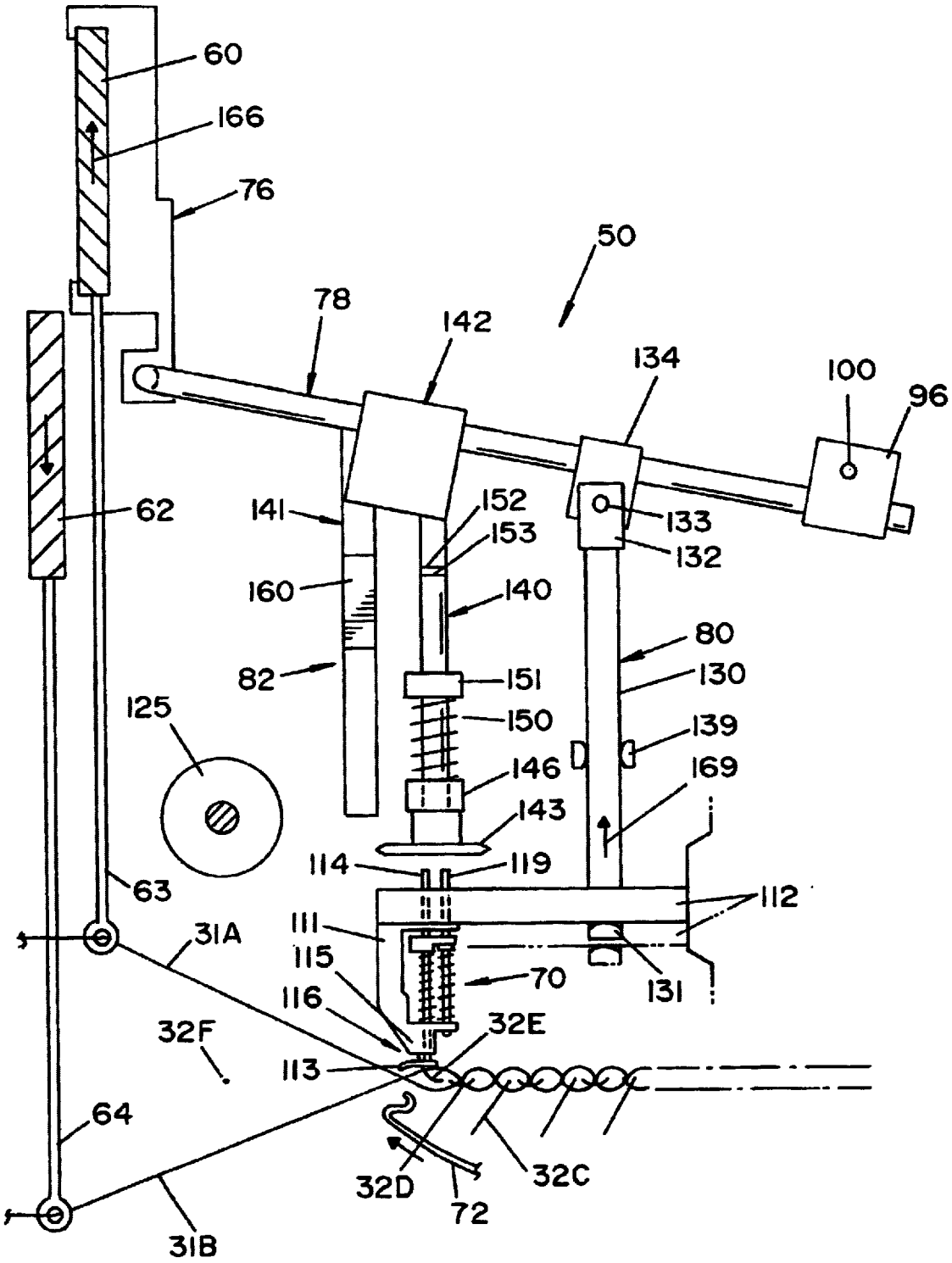

In FIG. 18B, at 180°, the harness 60 has completed its upward travel and the operating rod 78 has drawn the lifter 80 up, arrow 169, taking with it the selvage gripper 70, from its normal retracted position depicted in phantom. The gripper still retains the warp yarn 32E, as the opener shoe 143 has not contacted the rods 114 and 119. As the tucking needle 72 is inserted by the loom and reaches for the yarn 32E.

Figure 18C:
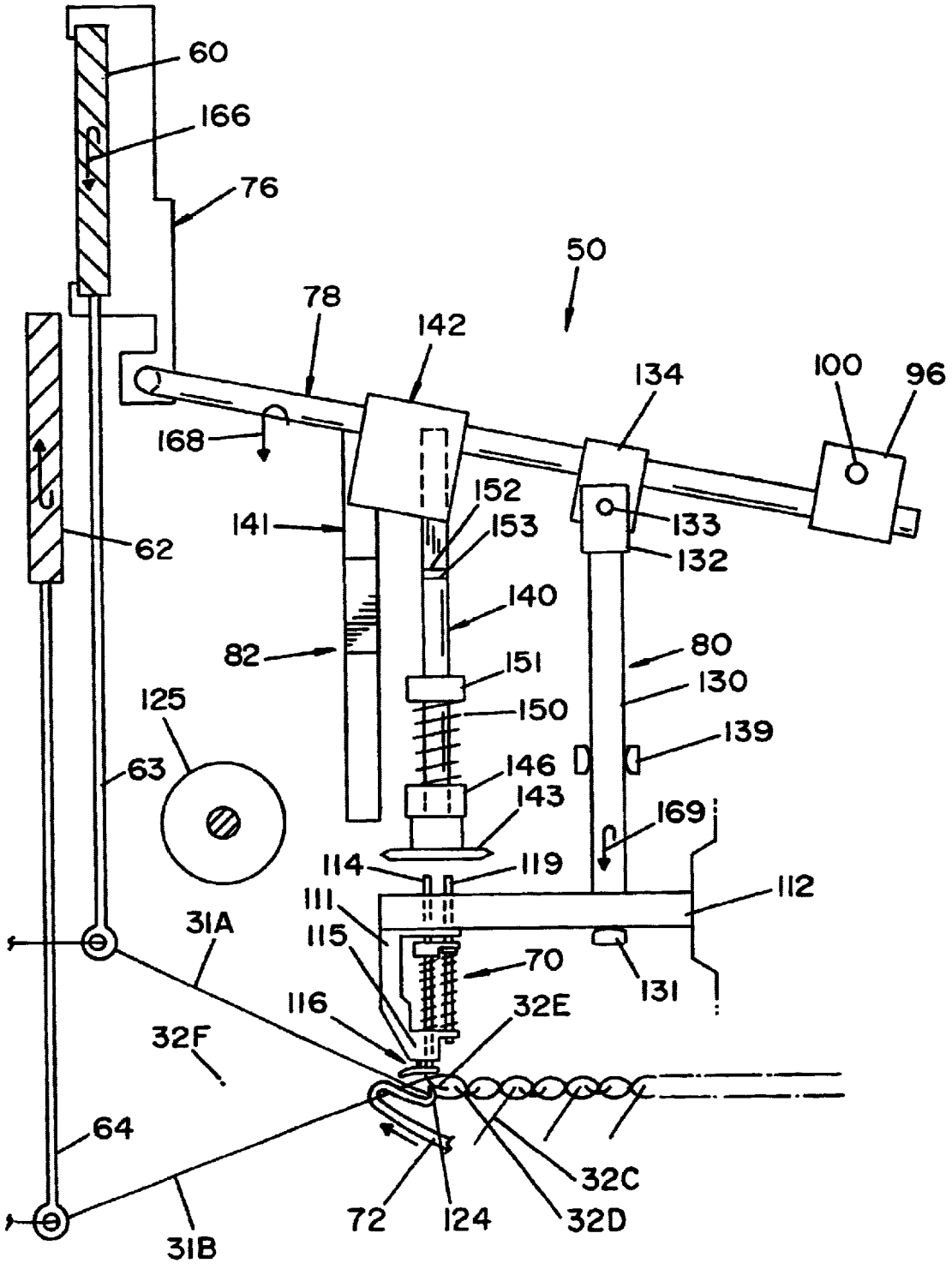

In FIG. 18C, at 200°, the tucking needle has failed to catch and tuck the yarn 32E and it will quickly retract by operation of the loom. In this view, the harness 60 has reversed and is beginning its downward movement. While the lifter 80 is still elevated, the operating rod 78 is beginning to move down which will bring the opener shoe 143 into contact with the rods 114 and 119.

Figure 18D:
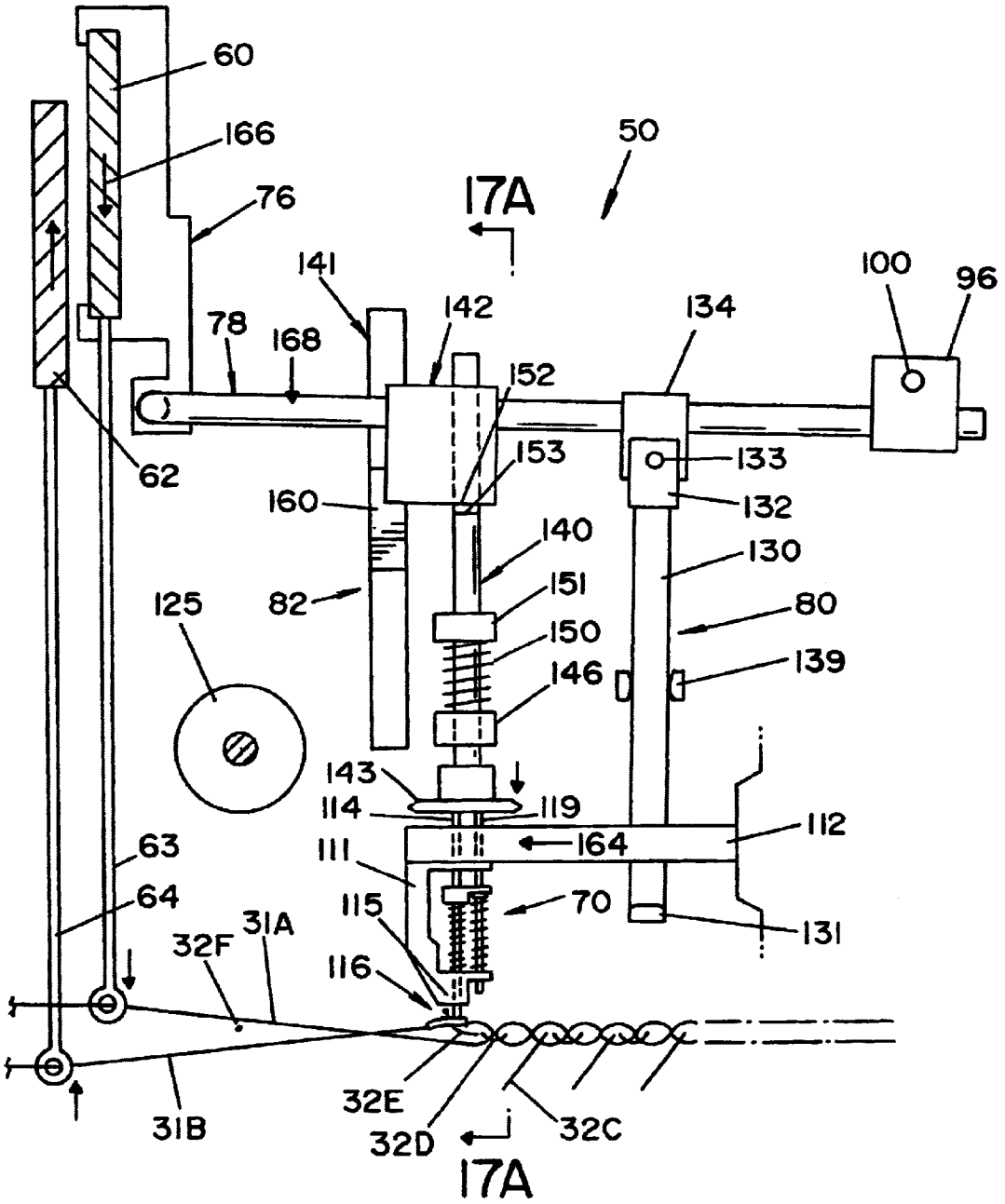

In FIG. 18D, at 310°, the harnesses 60 and 62 are nearly in equal planes, with 60 slightly above 62, and the operating rod 78 has moved downwardly to a substantially horizontal position. The ratchet block 142 has engaged the first step 152 (FIG. 17A), and the opener shoe 143 begins contacting the rods 114 and 119. Concurrently, the selvage gripper lever 112 begins to drive the gripper 70 forward, arrow 164, while the gripper starts to release the yarn 32E.

Figure 18E:
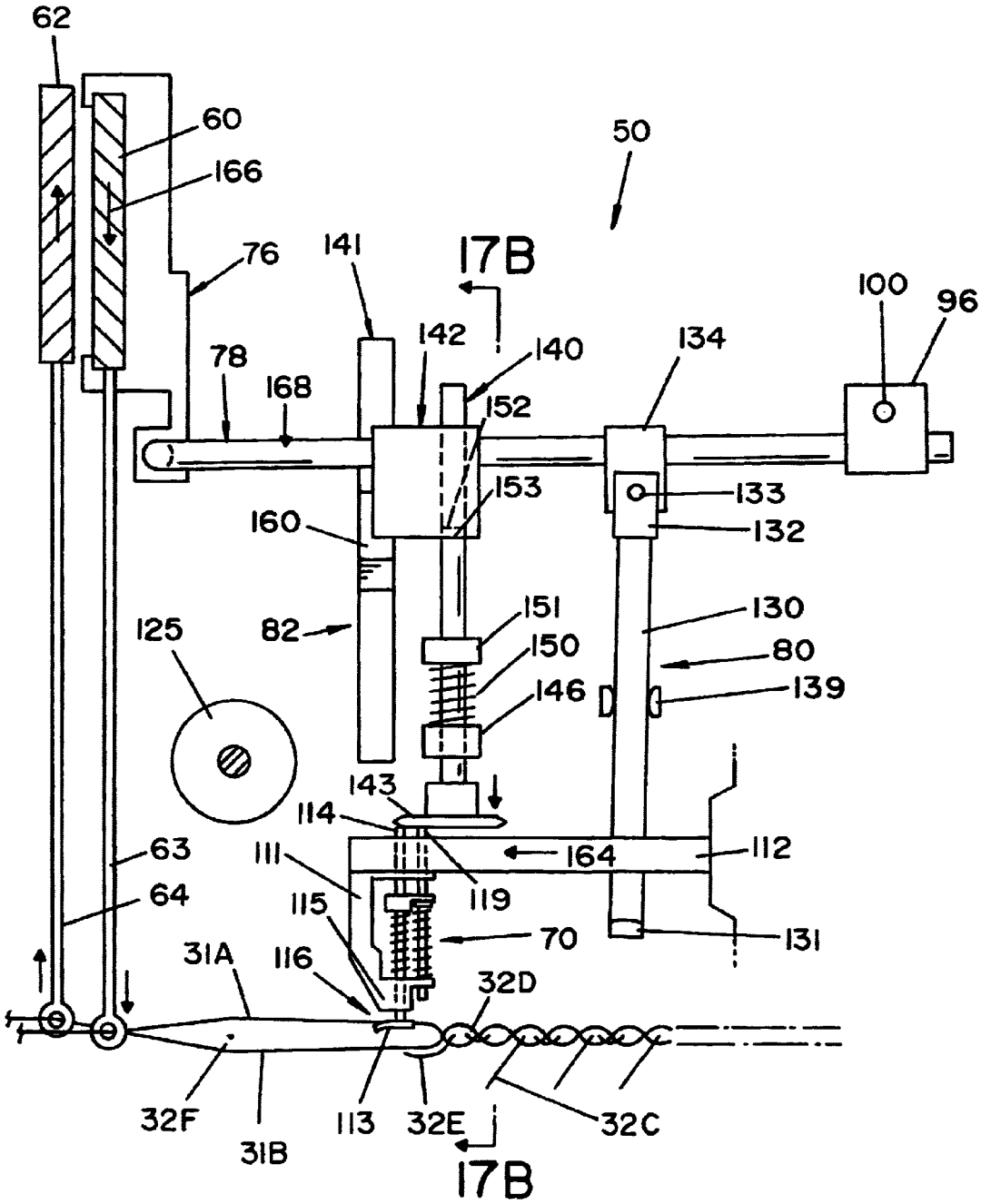

In FIG. 18E, at 330°, the harness 60 is still moving downwardly and is now slightly below the harness 62 causing the operating rod 78 to move to slightly below the horizontal position. The ratchet block 142 has now engaged the second step 153 (FIG. 17B), and the opener shoe 143 is still in contact with the rods 114 and 119. Forward travel of the selvage gripper lever 112 frees the clamp 116 from the yarn 32E and as the rod 119 passes beyond the shoe 143, the clamp again closes.

Figure 18F:
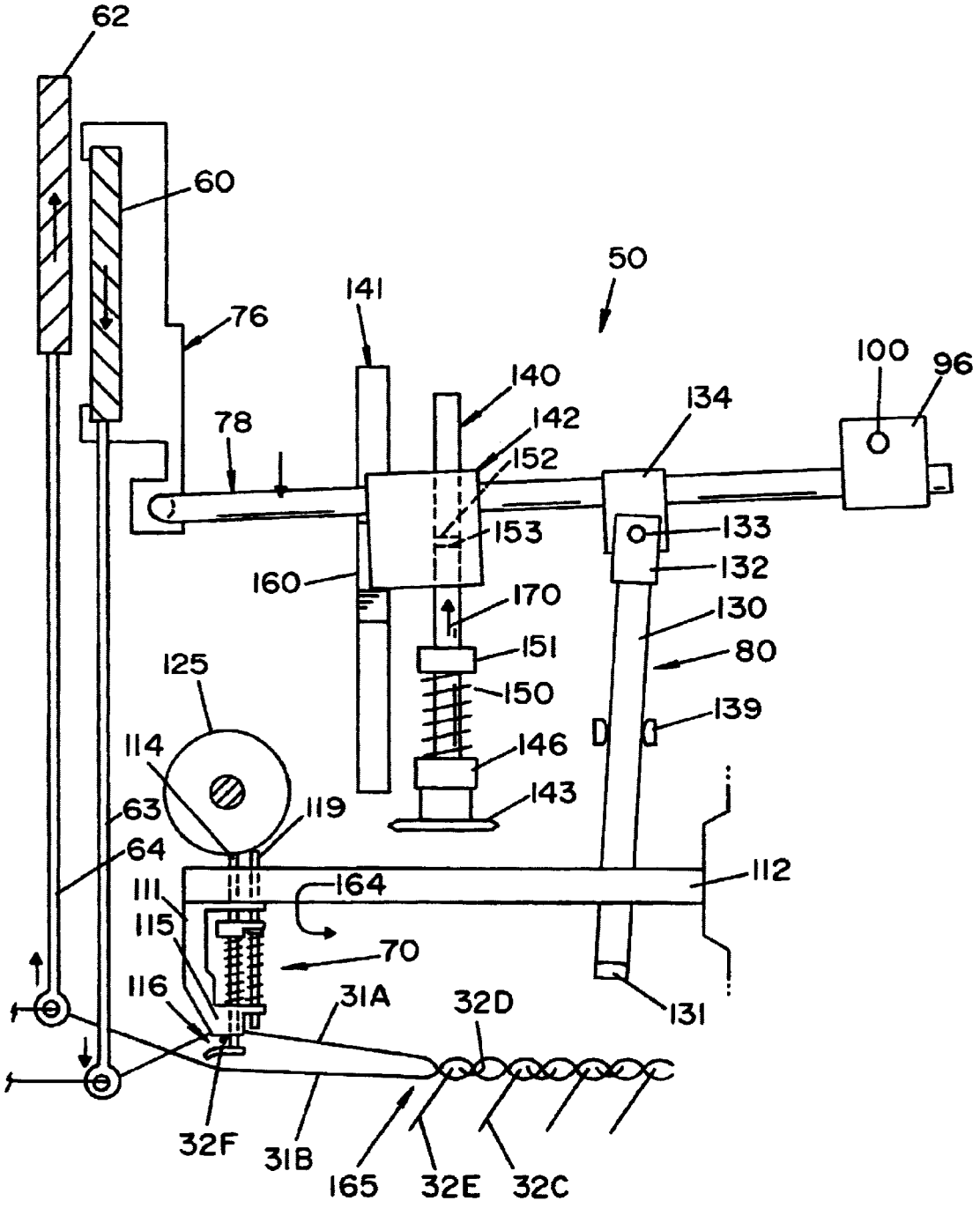

In FIG. 18F, at 350°, the harness 60 is still moving downwardly as is the operating rod 78. The ratchet block 142 has traveled along the ramp 160 of disengagement means 141, allowing the shoe rod 140 to retract, arrow 170, due to the spring 150. The selvage gripper 70 has completed its forward travel, into the path of the next delivered weft yarn end 32F. As the gripper 70 passes beneath the front roller 125, the rods 114 and 119 are engaged, first opening the clamp 116, and then as the lever 112 begins to retract, arrow 164, clamp 116 closes upon the yarn 32F, drawing it into the fell 165.

Figure 18G:
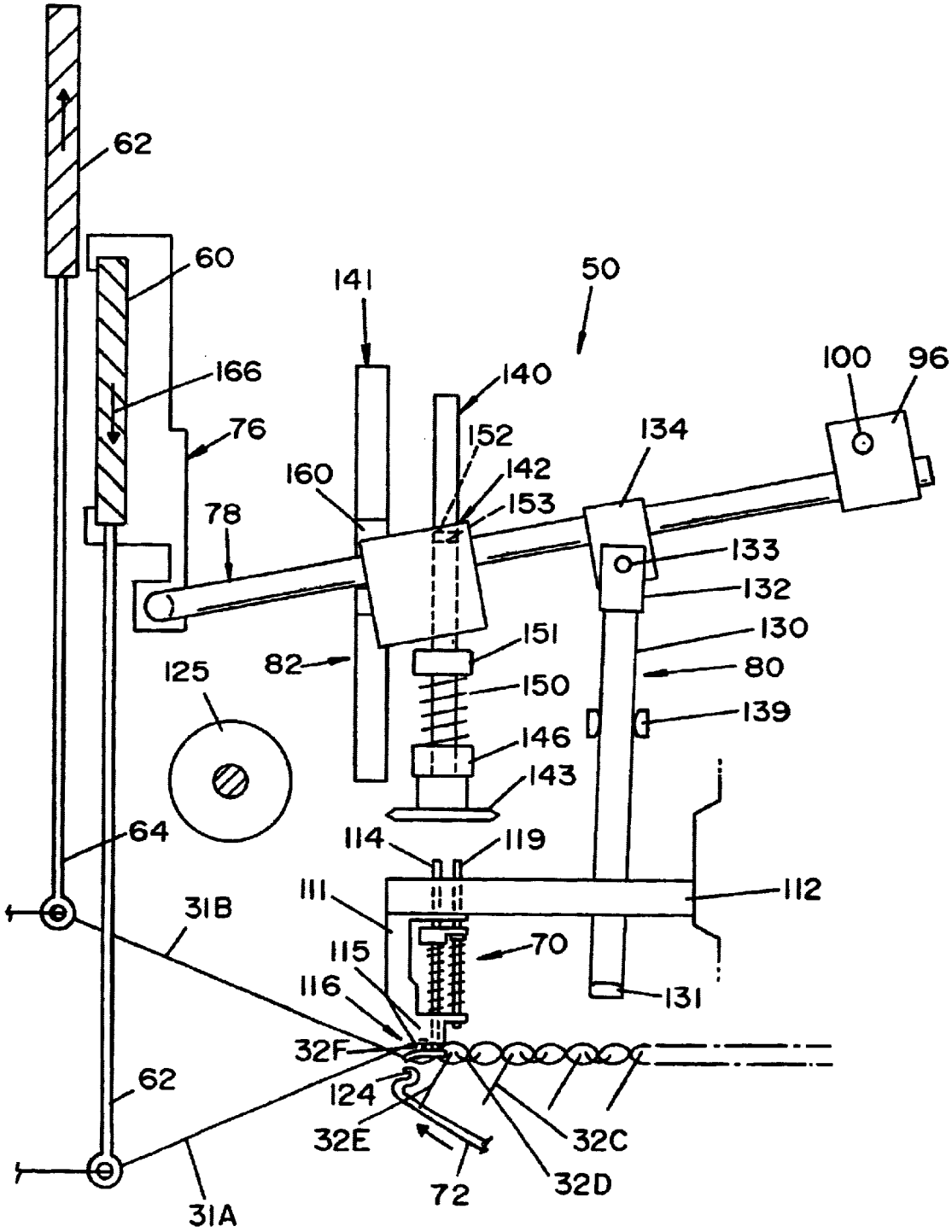

In FIG. 18G, at 148°, the harness 60 has completed its downward movement and the warp yarns 31A and 31B have captured the warp yarn 32F. The selvage gripper 70 has now returned to its retracted position and as the tucking needle 72 moves in to grab the yarn 32F.

Figure 18H:
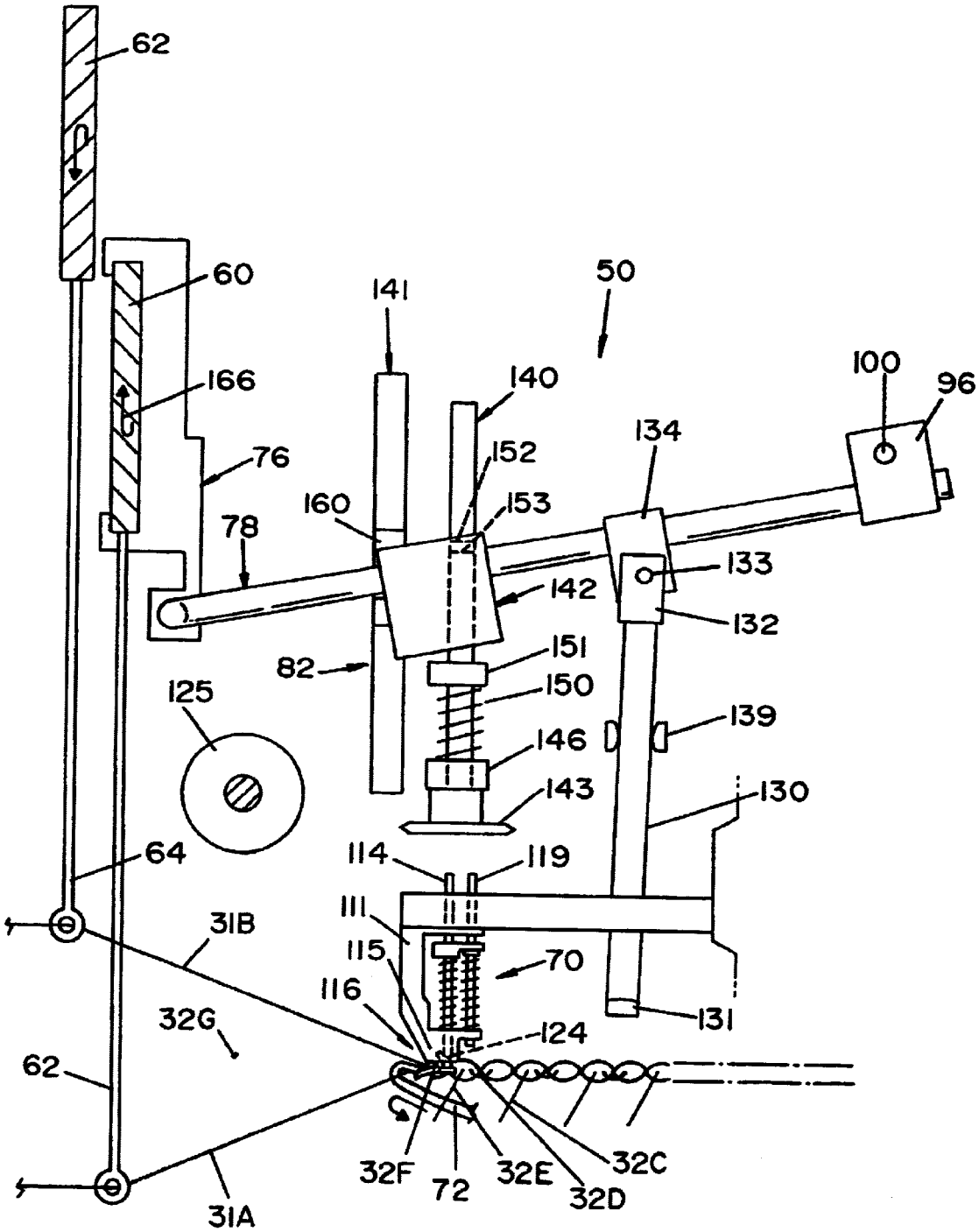

Finally, in FIG. 18H, at 280°, the tucking needle 72 has caught the yarn 32F in normal fashion. Then as the needle retracts, the warp yarn 32F is stripped from the gripper 70 and is tucked into the selvage. Thereafter, the next cycle begins as the harness 60 travels up and the gripper 70 is again moved forward.

In brief summary, the method of the present invention operates by tucking a weft yarn end into the selvage of the woven fabric; moving the selvage gripper forward to capture the next weft yarn end; opening and closing the clamp of the gripper onto the end; retracting the gripper and yarn end into the fell while raising the gripper out of the path of the tucking needle, causing the needle to miss the yarn end; releasing the untucked yarn end. The next cycle repeats by moving the selvage gripper forward to capture the next weft yarn end; opening and closing the clamp of the gripper onto the end; retracting the gripper and yarn end into the fell without raising the gripper; catching the yarn end with the tucking needle and tucking it into the selvage. Thereafter the cycles repeat in alternating fashion to produce a woven fabric having a tucked-untucked selvage.

As noted above, the method also includes a step of feeding one or more contrasting weft yarns into the fabric at periodic intervals to as to provide a visible indicia that the fabric is running true, that is, the weft yarns are all perpendicular to the warp yarns in the fabric. When this fabric is subsequently used in a further manufacturing operation, such as carpet tufting, the selvage is thinner, allowing the fabric to run truer on the apparatus and, the periodic contrasting pick line(s) provide indicia to the operator that the fabric is being fed evenly through the apparatus. As a further aid to reducing the selvage thickness, the weaving loom can employ thin warp yarns in the selvage area.

Thus it should be evident that the assembly and method of the present invention are highly effective in reducing the selvage area of woven primary backing for tufted broadloom carpet. The invention is particularly suited for primary backing fabric, but is necessarily limited thereto. The assembly and method of the present invention can be utilized with various weaving looms and should not be construed as limited to the equipment disclosed herein. It is also to be appreciated that the woven fabric of the present invention eliminates bowing and skewing of fabrics having fully tucked selvages and allows for the manufacture of broadloom having more uniform and stable tufted patterns.

Based upon the foregoing disclosure, it should now be apparent that the use of the woven fabric, as well as the assembly and method for the manufacture thereof, described herein will carry out the objects set forth hereinabove. It is, therefore, to be understood that any variations evident fall within the scope of the claimed invention and thus, the selection of specific component elements can be determined without departing from the spirit of the invention herein disclosed and described. In particular, woven fabrics according to the present invention are not necessarily limited to those having a contrasting pick line or pick lines at specific periodic intervals. Thus, the scope of the invention shall include all modifications and variations that may fall within the scope of the attached claims.

What is claimed is:

1. An assembly operable with tucking units of picking and receiving ends of a weaving loom for producing woven fabrics comprising:

plate means attached to said loom;

main drive block means connected to a harness of said loom;

operating rod means, having first and second ends and attached to said main drive block means at said first end and pivotally mounted to an upper surface of said plate means at said second end;

lifter means connected to said operating rod means, proximal to said second end, for lifting a weft end gripper of said loom; and means for selectively engaging said weft end gripper, operatively associated with said operating rod means, whereby said weft end gripper positions consecutive pick lines in an alternating fashion, allowing every other one to be tucked into a selvage of the fabric, while adjacent pick lines are untucked.

2. An assembly, as set forth in claim 1, whereby said means for selectively engaging said weft end gripper includes opener shoe means carried by said plate means and intermittently engagable with said weft end gripper of said loom for alternatingly gripping and releasing pick yarns;

opener ratchet means carried by said operating rod means above said opener shoe means, whereby said opener shoe means is driven downwardly to engage said weft end gripper in response to radial movement of said operating rod means; and disengagement means affixed to said plate means for controlling engagement between said opener ratchet block means and said opener shoe means in response to movement of said harness.

3. An assembly, as set forth in claim 2, wherein said opener shoe means includes a rod having first and second steps and carrying an opener shoe at its lower end.

4. An assembly, as set forth in claim 3, wherein said opener shoe means is movable within a guide block carried by said plate means and carries a spring biased against said guide block which is compressed when engaged by said opener ratchet means being driven downwardly by said operating rod means and which returns said opener shoe means when said opener ratchet block is disengaged therefrom.

5. An assembly, as set forth in claim 3, wherein said disengagement means is affixed to said plate providing a cam, extending outwardly from the plate, said cam being engaged by said opener ratchet means in response to downward movement of said operating rod means, allowing said ratchet means to disengage from said second step.

6. An assembly, as set forth in claim 2, wherein said opener ratchet means is mounted on said operating rod means between a clamp so as to be rotatably biased thereon and provides a pawl for engagement with said opener shoe means and said disengagement means.

7. An assembly, as set forth in claim 1, wherein said lifter means comprises a rod, providing a foot, which engages the operating lever of said weft end gripper with movement of said operating rod means.

8. A method for producing woven fabrics having a tucked-untucked selvage comprising:

providing an assembly at the picking and receiving ends of a weaving loom, operable with the weft end grippers of said loom;

attaching said assembly to a harness of the weaving loom; and operating said assembly so that said weft end grippers move every other weft yarn out of reach of the tucking needles of said loom.

9. A method for producing woven fabrics, as set forth in claim 8, wherein said step of operating includes raising and lowering said weft end gripper with movement of said harness.

10. A method for producing woven fabrics, as set forth in claim 9, further comprising:

gripping a weft yarn end with a weft end gripper;

raising said weft end gripper out of the path of said tucking needle;

opening said weft end gripper to release said weft yarn end;

moving said weft end gripper to capture a subsequent weft yarn end;

retracting said weft end gripper into the shed formed between warp yarns; and lowering said weft end gripper into the path of said tucking needle and releasing said yarn end for tucking into the selvage.

11. A method for producing woven fabrics, as set forth in claim 8, wherein said step of providing includes providing an assembly comprising:

plate means attached to said loom;

main drive block means connected to a harness of said loom;

operating rod means, having first and second ends and attached to said main drive block means at said first end and pivotally mounted to an upper surface of said plate means at said second end;

lifter means connected to said operating rod means, proximal to said second end, for lifting the weft end gripper of said loom; and means for selectively engaging said weft end gripper, operatively associated with said operating rod means, whereby said weft end gripper positions consecutive pick lines in an alternating fashion, allowing every other one to be tucked into the selvage of the fabric, while adjacent pick lines are untucked.

12. A method for producing woven fabrics, as set forth in claim 11, wherein said step of operating includes gripping a weft yarn end with a weft end gripper;

raising said weft end gripper out of the path of said tucking needle, with said lifter means;

opening said weft end gripper with said means for selectively engaging to release said weft yarn end;

moving said weft end gripper to capture a subsequent weft yarn end;

retracting said weft end gripper into the shed formed between warp yarns; and lowering said weft end gripper into the path of said tucking needle and releasing said yarn end for tucking into the selvage.

13. A method for producing woven fabrics, as set forth in claim 8, including the further step of feeding one or more contrasting weft yarns into the fabric at periodic intervals to as to provide an indicia of the perpendicularity of the fabric.

14. A method for producing woven fabrics having a tucked-untucked selvage on a weaving loom, providing selvage edge grippers and tucking needles, comprising:

moving said selvage gripper forward to capture a weft yarn end;

closing the clamp of said selvage gripper onto said weft yarn end;

catching said weft yarn end with said tucking needle and tucking it into the selvage;

moving said selvage gripper forward to capture the next weft yarn end;

closing the clamp of said selvage gripper onto said next weft yarn end;

retracting said selvage gripper and said next weft yarn end into the shed while raising said selvage gripper out of the path of the tucking needle, causing the needle to miss said yarn end;

releasing said untucked yarn end; and thereafter repeating the foregoing steps in alternating fashion to produce a woven fabric having a tucked-untucked selvage.

15. A method for producing woven fabrics, as set forth in claim 14, including the further step of feeding one or more contrasting weft yarns into the fabric at periodic intervals to as to provide an indicia of the perpendicularity of the fabric.

* * * * *